US009478225B2

(12) United States Patent
Sen

(10) Patent No.: US 9,478,225 B2
(45) Date of Patent: *Oct. 25, 2016

(54) SYSTEMS, METHODS, APPARATUS, AND COMPUTER-READABLE MEDIA FOR THREE-DIMENSIONAL AUDIO CODING USING BASIS FUNCTION COEFFICIENTS

(71) Applicant: QUALCOMM Incorporated, San Diego, CA (US)

(72) Inventor: Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/879,825

(22) Filed: Oct. 9, 2015

(65) Prior Publication Data

US 2016/0035358 A1 Feb. 4, 2016

Related U.S. Application Data

(63) Continuation of application No. 13/844,383, filed on Mar. 15, 2013, now Pat. No. 9,190,065.

(60) Provisional application No. 61/671,791, filed on Jul. 15, 2012, provisional application No. 61/731,474, filed on Nov. 29, 2012.

(51) Int. Cl.
*G10L 19/008* (2013.01)
*H04S 3/00* (2006.01)

(52) U.S. Cl.
CPC ..... *G10L 19/008* (2013.01); *H04S 3/008* (2013.01); *H04S 2400/01* (2013.01); *H04S 2400/03* (2013.01)

(58) Field of Classification Search
CPC . G10L 19/008; H04S 3/008; H04S 2400/03; H04S 2400/01
USPC ..... 381/23, 22, 17, 56; 704/20, 203, 224, 704/225, 226–230, 500–502; 700/94
See application file for complete search history.

(56) References Cited

U.S. PATENT DOCUMENTS

| | | | |
|---|---|---|---|
| 7,006,636 | B2 | 2/2006 | Baumgarte et al. |
| 7,356,465 | B2 | 4/2008 | Tsingos et al. |
| 7,756,713 | B2 | 7/2010 | Chong et al. |
| 8,234,122 | B2 | 7/2012 | Kim et al. |
| 8,855,320 | B2 | 10/2014 | Disch et al. |

(Continued)

FOREIGN PATENT DOCUMENTS

| | | | |
|---|---|---|---|
| JP | 2011530913 | A | 12/2011 |
| WO | 2011039195 | A1 | 4/2011 |

(Continued)

OTHER PUBLICATIONS

Advanced Television Systems Committee (ATSC): "ATSC Standard: Digital Audio Compression (AC-3, E-AC-3)," Doc. A/52:2012, Digital Audio Compression Standard, Mar. 23, 2012, 269 pp., Accessed online Jul. 15, 2012.

(Continued)

*Primary Examiner* — Melur Ramakrishnaiah
(74) *Attorney, Agent, or Firm* — Shumaker & Sieffert, P.A.

(57) ABSTRACT

Systems, methods, and apparatus for a unified approach to encoding different types of audio inputs are described.

19 Claims, 22 Drawing Sheets

(56) References Cited

U.S. PATENT DOCUMENTS

| | | | | |
|---|---|---|---|---|
| 9,190,065 | B2 | 11/2015 | Sen | |
| 2005/0131680 | A1 | 6/2005 | Chazan et al. | |
| 2006/0126852 | A1* | 6/2006 | Bruno | H04S 1/002 381/17 |
| 2008/0004729 | A1 | 1/2008 | Hiipakka | |
| 2009/0100990 | A1* | 4/2009 | Cremer | G10H 1/06 84/623 |
| 2009/0125313 | A1 | 5/2009 | Hellmuth et al. | |
| 2009/0125314 | A1 | 5/2009 | Hellmuth et al. | |
| 2009/0265164 | A1 | 10/2009 | Yoon et al. | |
| 2010/0014692 | A1 | 1/2010 | Schreiner et al. | |
| 2010/0094631 | A1 | 4/2010 | Engdegard et al. | |
| 2010/0121647 | A1 | 5/2010 | Beack et al. | |
| 2010/0228554 | A1 | 9/2010 | Beack et al. | |
| 2011/0002469 | A1 | 1/2011 | Ojala | |
| 2011/0022402 | A1 | 1/2011 | Engdegard et al. | |
| 2011/0040395 | A1 | 2/2011 | Kraemer et al. | |
| 2011/0182432 | A1 | 7/2011 | Ishikawa et al. | |
| 2011/0249821 | A1 | 10/2011 | Jaillet et al. | |
| 2011/0264456 | A1 | 10/2011 | Koppens et al. | |
| 2012/0014527 | A1 | 1/2012 | Furse | |
| 2012/0114126 | A1 | 5/2012 | Thiergart et al. | |
| 2012/0128160 | A1 | 5/2012 | Kim et al. | |
| 2012/0128165 | A1 | 5/2012 | Visser et al. | |
| 2012/0155653 | A1 | 6/2012 | Jax et al. | |
| 2012/0232910 | A1 | 9/2012 | Dressler et al. | |
| 2012/0314878 | A1 | 12/2012 | Daniel et al. | |
| 2014/0016786 | A1 | 1/2014 | Sen | |
| 2014/0086416 | A1 | 3/2014 | Sen | |

FOREIGN PATENT DOCUMENTS

| | | | |
|---|---|---|---|
| WO | 2011160850 | A1 | 12/2011 |
| WO | 2012098425 | A1 | 7/2012 |

OTHER PUBLICATIONS

Bates, "The Composition and Performance of Spatial Music", Ph.D. thesis, Univ. of Dublin, Aug. 2009, pp. 257, Accessed online Jul. 22, 2013 at http://endabates.net/Enda%20Bates%20-%20The%20Composition%20and%20Performance%20of%20Spatial%20Music.pdf.

Breebaart, et al., "Background, Concept, and Architecture for the Recent MPEG Surround Standard on Multichannel Audio Compression", pp. 21, J. Audio Eng. Soc., vol. 55, No. 5, May 2007, Accessed online Jul. 9, 2012; available online Jul. 22, 2013 at www.jeroenbreebaart.com/papers/jaes/jaes2007.pdf.

Breebaart, et al., "Binaural Rendering in MPEG Surround", EURASIP Journal on Advances in Signal Processing, vol. 2008, Article ID 732895, 14 pp.

Breebaart, et al., "MPEG Spatial Audio coding/MPEG surround: Overview and Current Status," Audio Engineering Society Convention Paper, Presented at the 119th Convention, Oct. 7-10, 2005, USA, 17 pp.

Chen, et al., "Spatial Parameters for Audio Coding: MDCT Domain Analysis and Synthesis", Multimedia Tools and Applications, Kluwer Academic Publishers, BO, vol. 48, No. 2, Jul. 22, 2009, pp. 225-246, XP019793359, 22 pp.

Eigenmike Microphone, "Digital Signal Processing, Acoustics and Product Design," products, mhacoustics.com, Jul. 14, 2014, 4 pp.

"White Paper: The MPEG Standard on Parametric Object Based Audio Coding", Fraunhofer Institute for Integrated Circuits; 2012, pp. 4, Accessed online Jul. 5, 2012; available online Jul. 22, 2013 at http://www.iis.fraunhofer.de/content/dam/iis/en/dokumente/AMM/SAOC-wp_2012.pdf.

Herre, "Efficient Representation of Sound Images: Recent Developments in Parametric Coding of Spatial Audio," pp. 40, Accessed online Jul. 9, 2012; accessed online Jul. 22, 2012 at www.img.lx.it.pt/pcs2007/presentations/JurgenHere_Sound_Images.pdf.

Herre, et al., "MPEG Surround—The ISO/MPEG Standard for Efficient and Compatible Multichannel Audio Coding", J. Audio Eng. Soc., vol. 56, No. 11, Nov. 2008, pp. 24, Accessed online Jul. 9, 2012; available online Jul. 22, 2013 at www.jeroenbreebaart.com/papers/jaes/jaes2008.pdf.

Herre, "Personal Audio: From Simple Sound Reproduction to Personalized Interactive Rendering", pp. 22, Accessed online Jul. 9, 2012; available online Jul. 22, 2013 at http://www.audiomostly.com/amc2007/programme/presentations/AudioMostlyHerre.pdf.

International Search Report and Written Opinion from International Application No. PCT/US2013/050222, dated Oct. 4, 2013, 12.

International Telecommunication Union (ITU): "Recommendation ITU-R BS.775-1: Multichannel Stereophonic Sound System With and Without Accompanying Picture", pp. 10, Jul. 1994.

ISO/IEC 14496-3:2009, "Information technology—Coding of audio-visual objects—Part 3: Audio," Int'l Org. for Standardization, Geneva, CH, 4th Edition, Aug. 26, 2009, 1404 pp.

Malham, "Spherical Harmonic Coding of Sound Objects—the Ambisonic 'O' Format," 19tyh International Conference: Surround Sound—Techniques, Technology and Preception, Jun. 1, 2001, 4 pp. URL: pcfarina.eng.unipr.it/public/O-format/AES19-Malham.pdf.

"Metadata Standards and Guidelines Relevant to Digital Audio", Prepared by the Preservation and Reformatting Section (PARS) Task Force on Audio Preservation Metadata in cooperation with the Music Library Association (MLA) Bibliographic Control Committee (BCC) Metadata Subcommittee, Feb. 17, 2010, pp. 5, Accessed online Jul. 22, 2013 at www.ala.org/alcts/files/resources/preserv/audio_metadata.pdf.

Muscade Consortium: "D1.1.2: Reference architecture and representation format—Phase I", Ref. MUS. RP.00002.THO, Jun. 30, 2010, pp. 39, Accessed online Jul. 22, 2013 at www.muscade.eu/deliverables/D1.1.2.PDF.

Silzle, "How to Find Future Audio Formats?" 2009, pp. 15, Accessed online Oct. 1, 2012; available online Jul. 22, 2013 at http://www.tonmeister.de/symposium/2009/np_pdf/A08.pdf.

Spors, et al., "Evaluation of Perceptual Properties of Phase-mode Beamforming in the Context of data-based Binaural Synthesis", Communications Control and Signal Processing (ISCCSP), 2012 5th International Symposium on, IEEE, May 2, 2012, XP032188234, 4 pp.

Ville, et al., "Efficient Spatial Sound Synthesis for Virtual Worlds", Conference: 35th International Conference: Audio for Games; Feb. 2009, AES, 60 East 42nd Street, Room 2520 New York 10165-2520, USA, Feb. 11-13, 2009, XP040509261, 10 pp.

West, "Chapter 2: Spatial Hearing", Accessed online Jul. 5, 2012 at http://www.music.miami.edu/programs/mue/Research/jwest/Chap_2/Chap_2_Spatial_Hearing.html, 10 pp.

Reply to Written Opinion mailed Oct. 4, 2013, from International Application No. PCT/US20013/050222, dated May 15, 2014, 17 pp.

"Multimedia Scalable 3D for Europe: D1.1.2: Reference architecture and representation format—Phase I," Muscade Consortium 2010, Jun. 30, 2012, 39 pp. URL: www.muscade.eu/deliverables/D1.1.2.PDF.

International Preliminary Report on Patentability from International Application No. PCT/US2013/050222, mailed Nov. 24, 2014, 7 pp.

Response to Second Written Opinion mailed Jul. 15, 2014, from International Application No. PCT/US2013/050222, dated Sep. 15, 2014, 16 pp.

Second Written Opinion from International Application No. PCT/US2013/050222, dated Jul. 15, 2014, 5 pp.

Herre, et al., "Interactive Teleconferencing Combining Spatial Audio Object Coding and DirAC Technology," Journal of the Audio Engineering Society, U.S., Audio Engineering Society, Dec. 2011, vol. 59, No. 12, pp. 924-935.

Thiergart, et al.,Three-Dimensional Sound Field Analysis with Directional Audio Coding based on Signal Adaptive Parameter Estimators, Proc. 40th International Conference of AES,Japan, Audio Engineering Society, Oct. 8, 2010, 9 pp.

Pulkki, et al., Efficient Spatial Sound Synthesis for Virtual Worlds, Proc. 35th International Conference of AES,U.K., Audio Engineering Society, Feb. 11-13, 2009, 10 pp.

* cited by examiner

SYSTEMS, METHODS, APPARATUS, AND COMPUTER-READABLE MEDIA FOR THREE-DIMENSIONAL AUDIO CODING USING BASIS FUNCTION COEFFICIENTS

This application is a continuation of U.S. application Ser. No. 13/844,383, filed Mar. 15, 2013, which claims the benefit of U.S. Provisional Application No. 61/671,791, filed Jul. 15, 2012, and U.S. Provisional Application No. 61/731,474, filed Nov. 29, 2012, the entire contents of which are incorporated herein by reference.

TECHNICAL FIELD

This disclosure relates to spatial audio coding.

BACKGROUND

The evolution of surround sound has made available many output formats for entertainment nowadays. The range of surround-sound formats in the market includes the popular 5.1 home theatre system format, which has been the most successful in terms of making inroads into living rooms beyond stereo. This format includes the following six channels: front left (L), front right (R), center or front center (C), back left or surround left (Ls), back right or surround right (Rs), and low frequency effects (LFE)). Other examples of surround-sound formats include the growing 7.1 format and the futuristic 22.2 format developed by NHK (Nippon Hoso Kyokai or Japan Broadcasting Corporation) for use, for example, with the Ultra High Definition Television standard. It may be desirable for a surround sound format to encode audio in two dimensions and/or in three dimensions.

SUMMARY

A method of audio signal processing according to a general configuration includes encoding an audio signal and spatial information for the audio signal into a first set of basis function coefficients that describes a first sound field. This method also includes combining the first set of basis function coefficients with a second set of basis function coefficients that describes a second sound field during a time interval to produce a combined set of basis function coefficients that describes a combined sound field during the time interval. Computer-readable storage media (e.g., non-transitory media) having tangible features that cause a machine reading the features to perform such a method are also disclosed.

An apparatus for audio signal processing according to a general configuration includes means for encoding an audio signal and spatial information for the audio signal into a first set of basis function coefficients that describes a first sound field; and means for combining the first set of basis function coefficients with a second set of basis function coefficients that describes a second sound field during a time interval to produce a combined set of basis function coefficients that describes a combined sound field during the time interval.

An apparatus for audio signal processing according to another general configuration includes an encoder configured to encode an audio signal and spatial information for the audio signal into a first set of basis function coefficients that describes a first sound field. This apparatus also includes a combiner configured to combine the first set of basis function coefficients with a second set of basis function coefficients that describes a second sound field during a time interval to produce a combined set of basis function coefficients that describes a combined sound field during the time interval.

DETAILED DESCRIPTION

Figure 1A:
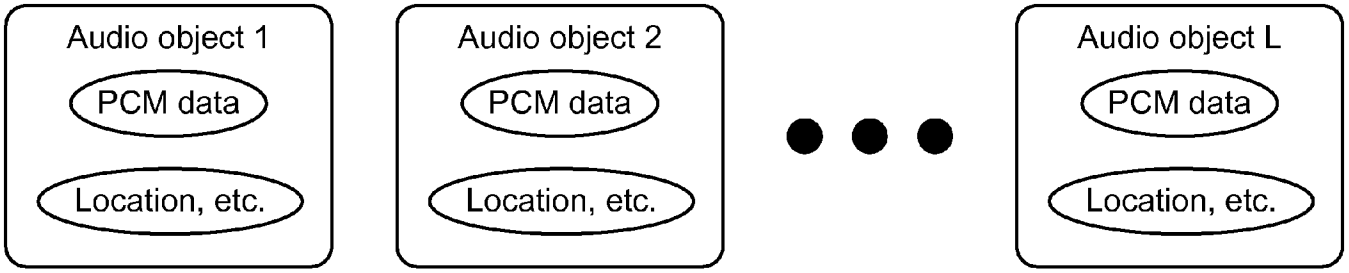
FIG. 1A illustrates an example of L audio objects.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B" or "A is the same as B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

Any incorporation by reference of a portion of a document shall also be understood to incorporate definitions of terms or variables that are referenced within the portion, where such definitions appear elsewhere in the document, as well as any figures referenced in the incorporated portion. Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, each of the terms "plurality" and "set" is used herein to indicate an integer quantity that is greater than one.

The current state of the art in consumer audio is spatial coding using channel-based surround sound, which is meant to be played through loudspeakers at pre-specified positions. Channel-based audio involves the loudspeaker feeds for each of the loudspeakers, which are meant to be positioned in a predetermined location (such as for 5.1 surround sound/home theatre and the 22.2 format).

Another main approach to spatial audio coding is object-based audio, which involves discrete pulse-code-modulation (PCM) data for single audio objects with associated metadata containing location coordinates of the objects in space (amongst other information). An audio object encapsulates individual pulse-code-modulation (PCM) data streams, along with their three-dimensional (3D) positional coordinates and other spatial information encoded as metadata. In the content creation stage, individual spatial audio objects (e.g., PCM data) and their location information are encoded separately. FIG. 1A illustrates an example of L audio objects. At the decoding and rendering end, the metadata is combined with the PCM data to recreate the 3D sound field.

Figure 1B:
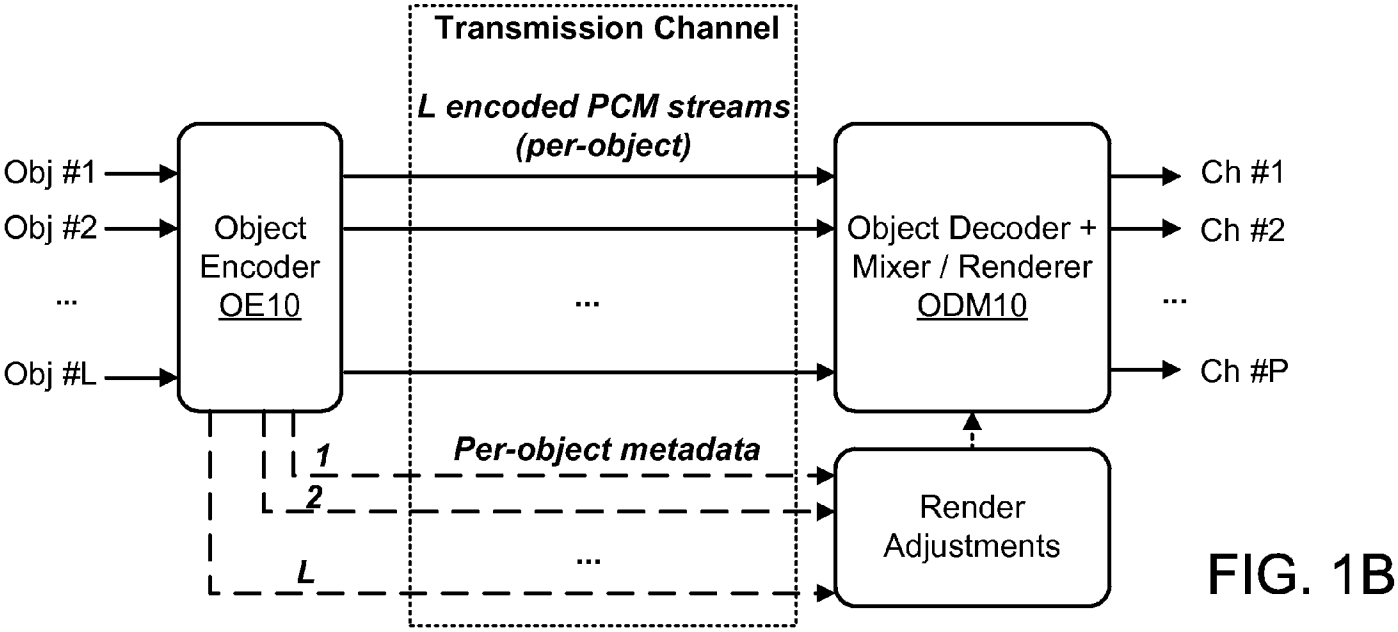
FIG. 1B shows a conceptual overview of one object-based coding approach.

Two examples that use the object-based philosophy are provided here for reference. FIG. 1B shows a conceptual overview of the first example, an object-based coding scheme in which each sound source PCM stream is individually encoded and transmitted by an encoder OE10, along with their respective metadata (e.g., spatial data). At the renderer end, the PCM objects and the associated metadata are used (e.g., by decoder/mixer/renderer ODM10) to calculate the speaker feeds based on the positions of the speakers. For example, a panning method (e.g., vector base amplitude panning or VBAP) may be used to individually spatialize the PCM streams back to a surround-sound mix. At the renderer end, the mixer usually has the appearance of a multi-track editor, with PCM tracks laying out and spatial metadata as editable control signals.

Although an approach as shown in FIG. 1B allows maximum flexibility, it also has potential drawbacks. Obtaining individual PCM audio objects from the content creator may be difficult, and the scheme may provide an insufficient level of protection for copyrighted material, as the decoder end can easily obtain the original audio objects. Also the soundtrack of a modern movie can easily involve hundreds of overlapping sound events, such that encoding each PCM individually may fail to fit all the data into limited-bandwidth transmission channels even with a moderate number of audio objects. Such a scheme does not address this bandwidth challenge, and therefore this approach may be prohibitive in terms of bandwidth usage.

Figure 2A:
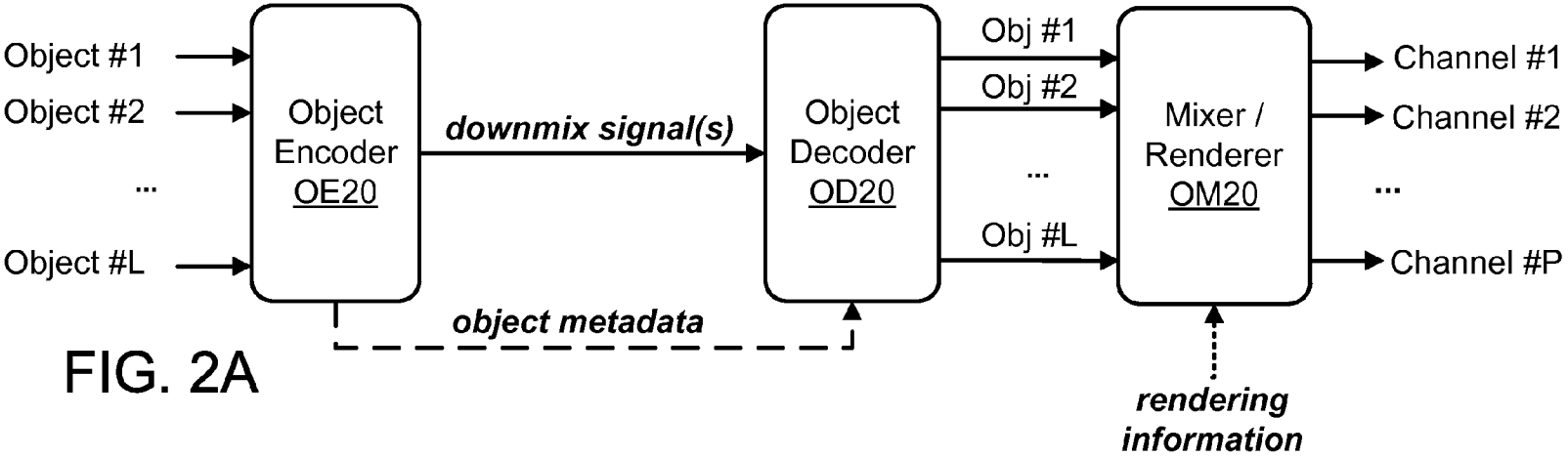
FIGS. 2A and 2B show conceptual overviews of Spatial Audio Object Coding (SAOC).
Figure 2B:
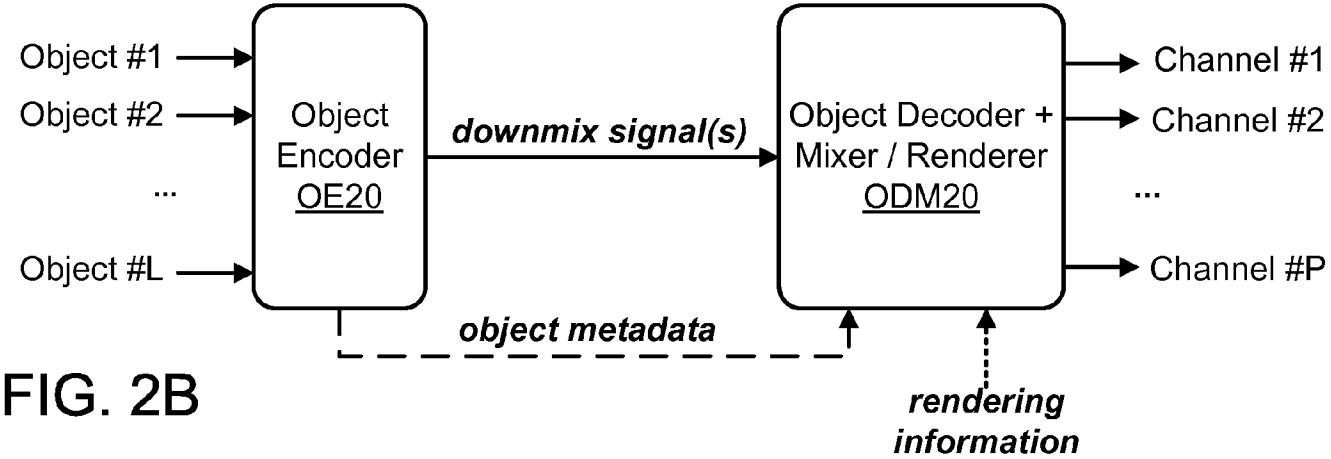

The second example is Spatial Audio Object Coding (SAOC), in which all objects are downmixed to a mono or stereo PCM stream for transmission. Such a scheme, which is based on binaural cue coding (BCC), also includes a metadata bitstream, which may include values of parameters such as interaural level difference (ILD), interaural time difference (ITD), and inter-channel coherence (ICC, relating to the diffusivity or perceived size of the source) and may be encoded (e.g., by encoder OE20) into as little as one-tenth of an audio channel. FIG. 2A shows a conceptual diagram of an SAOC implementation in which the decoder OD20 and mixer OM20 are separate modules. FIG. 2B shows a conceptual diagram of an SAOC implementation that includes an integrated decoder and mixer ODM20.

In implementation, SAOC is tightly coupled with MPEG Surround (MPS, ISO/IEC 14496-3, also called High-Efficiency Advanced Audio Coding or HeAAC), in which the six channels of a 5.1 format signal are downmixed into a mono or stereo PCM stream, with corresponding side-information (such as ILD, ITD, ICC) that allows the synthesis of the rest of the channels at the renderer. While such a scheme may have a quite low bit rate during transmission, the flexibility of spatial rendering is typically limited for SAOC. Unless the intended render locations of the audio objects are very close to the original locations, it can be expected that audio quality will be compromised. Also, when the number of audio objects increases, doing individual processing on each of them with the help of metadata may become difficult.

For object-based audio, it may be desirable to address the excessive bit-rate or bandwidth that would be involved when there are many audio objects to describe the sound field. Similarly, the coding of channel-based audio may also become an issue when there is a bandwidth constraint.

A further approach to spatial audio coding (e.g., to surround-sound coding) is scene-based audio, which involves representing the sound field using coefficients of spherical harmonic basis functions. Such coefficients are also called "spherical harmonic coefficients" or SHC. Scene-based audio is typically encoded using an Ambisonics format, such as B-Format. The channels of a B-Format signal correspond to spherical harmonic basis functions of the sound field, rather than to loudspeaker feeds. A first-order B-Format signal has up to four channels (an omnidirectional channel W and three directional channels X,Y,Z); a second-order B-Format signal has up to nine channels (the four first-order channels and five additional channels R,S,T,U,V); and a third-order B-Format signal has up to sixteen channels (the nine second-order channels and seven additional channels K,L,M,N,O,P,Q).

Figure 3A:
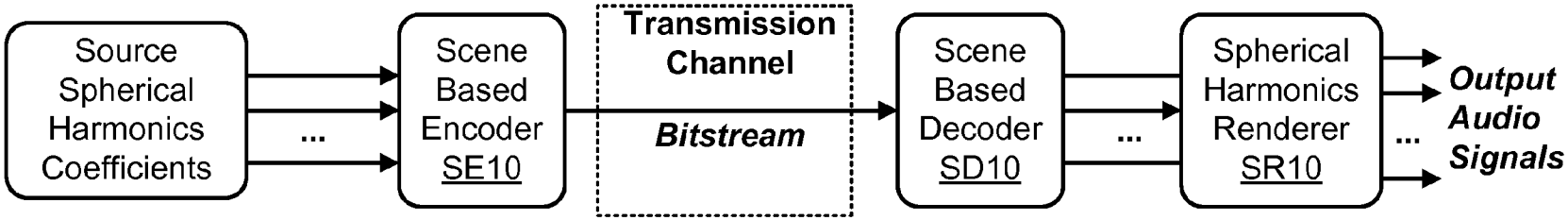
FIG. 3A shows an example of scene-based coding.

FIG. 3A depicts a straightforward encoding and decoding process with a scene-based approach. In this example, scene-based encoder SE10 produces a description of the SHC that is transmitted (and/or stored) and decoded at the scene-based decoder SD10 to receive the SHC for rendering (e.g., by SH renderer SR10). Such encoding may include one or more lossy or lossless coding techniques for bandwidth compression, such as quantization (e.g., into one or more codebook indices), error correction coding, redundancy coding, etc. Additionally or alternatively, such encoding may include encoding audio channels (e.g., microphone outputs) into an Ambisonic format, such as B-format, G-format, or Higher-order Ambisonics (HOA). In general, encoder SE10 may encode the SHC using techniques that take advantage of redundancies among the coefficients and/or irrelevancies (for either lossy or lossless coding).

Figure 3B:
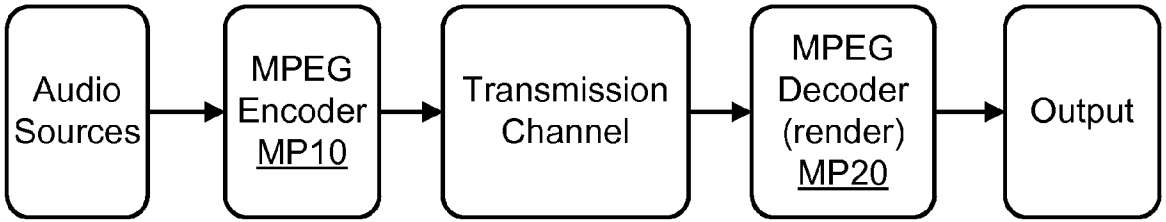
FIG. 3B illustrates a general structure for standardization using an MPEG codec.

It may be desirable to provide an encoding of spatial audio information into a standardized bit stream and a subsequent decoding that is adaptable and agnostic to the speaker geometry and acoustic conditions at the location of the renderer. Such an approach may provide the goal of a uniform listening experience regardless of the particular setup that is ultimately used for reproduction. FIG. 3B illustrates a general structure for such standardization, using an MPEG codec. In this example, the input audio sources to encoder MP10 may include any one or more of the following, for example: channel-based sources (e.g., 1.0 (monophonic), 2.0 (stereophonic), 5.1, 7.1, 11.1, 22.2), object-based sources, and scene-based sources (e.g., high-order spherical harmonics, Ambisonics). Similarly, the audio output produced by decoder (and renderer) MP20 may include any one or more of the following, for example: feeds for monophonic, stereophonic, 5.1, 7.1, and/or 22.2 loudspeaker arrays; feeds for irregularly distributed loudspeaker arrays; feeds for headphones; interactive audio.

It may also be desirable to follow a 'create-once, use-many' philosophy in which audio material is created once (e.g., by a content creator) and encoded into formats which can subsequently be decoded and rendered to different outputs and loudspeaker setups. A content creator such as a Hollywood studio, for example, would typically like to produce the soundtrack for a movie once and not expend the effort to remix it for each possible loudspeaker configuration.

It may be desirable to obtain a standardized encoder that will take any one of three types of inputs: (i) channel-based, (ii) scene-based, and (iii) object-based. This disclosure describes methods, systems, and apparatus that may be used to obtain a transformation of channel-based audio and/or object-based audio into a common format for subsequent encoding. In this approach, the audio objects of an object-based audio format, and/or the channels of a channel-based audio format, are transformed by projecting them onto a set of basis functions to obtain a hierarchical set of basis function coefficients. In one such example, the objects and/or channels are transformed by projecting them onto a set of spherical harmonic basis functions to obtain a hierarchical set of spherical harmonic coefficients or SHC. Such an approach may be implemented, for example, to allow a unified encoding engine as well as a unified bitstream (since a natural input for scene-based audio is also SHC). FIG. 8 as discussed below shows a block diagram for one example AP150 of such a unified encoder. Other examples of hierarchical sets include sets of wavelet transform coefficients and other sets of coefficients of multiresolution basis functions.

The coefficients generated by such a transform have the advantage of being hierarchical (i.e., having a defined order relative to one another), making them amenable to scalable coding. The number of coefficients that are transmitted (and/or stored) may be varied, for example, in proportion to the available bandwidth (and/or storage capacity). In such case, when higher bandwidth (and/or storage capacity) is available, more coefficients can be transmitted, allowing for greater spatial resolution during rendering. Such transformation also allows the number of coefficients to be independent of the number of objects that make up the sound field, such that the bit-rate of the representation may be independent of the number of audio objects that were used to construct the sound field.

A potential benefit of such a transformation is that it allows content providers to make their proprietary audio objects available for the encoding without the possibility of them being accessed by end-users. Such a result may be obtained with an implementation in which there is no lossless reverse transformation from the coefficients back to the original audio objects. For instance, protection of such proprietary information is a major concern of Hollywood studios.

Using a set of SHC to represent a sound field is a particular example of a general approach of using a hierarchical set of elements to represent a sound field. A hierarchical set of elements, such as a set of SHC, is a set in which the elements are ordered such that a basic set of lower-ordered elements provides a full representation of the modeled sound field. As the set is extended to include higher-order elements, the representation of the sound field in space becomes more detailed.

The source SHC (e.g., as shown in FIG. 3A) may be source signals as mixed by mixing engineers in a scene-based-capable recording studio. The source SHC may also be generated from signals captured by a microphone array or from a recording of a sonic presentation by a surround array of loudspeakers. Conversion of a PCM stream and associated location information (e.g., an audio object) into a source set of SHC is also contemplated.

The following expression shows an example of how a PCM object $s_i(t)$, along with its metadata (containing location co-ordinates, etc.), may be transformed into a set of SHC:

$$s_i(t, r_l, \theta_l, \varphi_l) = \sum_{\omega=0}^{\infty}\left[\sum_{n=0}^{\infty} j_n(kr_l)\sum_{m=-n}^{n} A_n^m(k)Y_n^m(\theta_l, \varphi_l)\right]e^{j\omega t}, \quad (1)$$

where $$k = \frac{\omega}{c},$$

c is the speed of sound (~343 m/s), $\{r_l,\theta_l,\phi_l\}$ is a point of reference (or observation point) within the sound field, $j_n(\bullet)$ is the spherical Bessel function of order n, and $Y_n^m(\theta_1,\phi_l)$ are the spherical harmonic basis functions of order n and suborder m (some descriptions of SHC label n as degree (i.e. of the corresponding Legendre polynomial) and m as order). It can be recognized that the term in square brackets is a frequency-domain representation of the signal (i.e., $S(\omega,r_l,\theta_l,\phi_l)$) which can be approximated by various time-frequency transformations—such as the discrete Fourier transform (DFT), the discrete cosine transform (DCT), or a wavelet transform.

Figure 4:
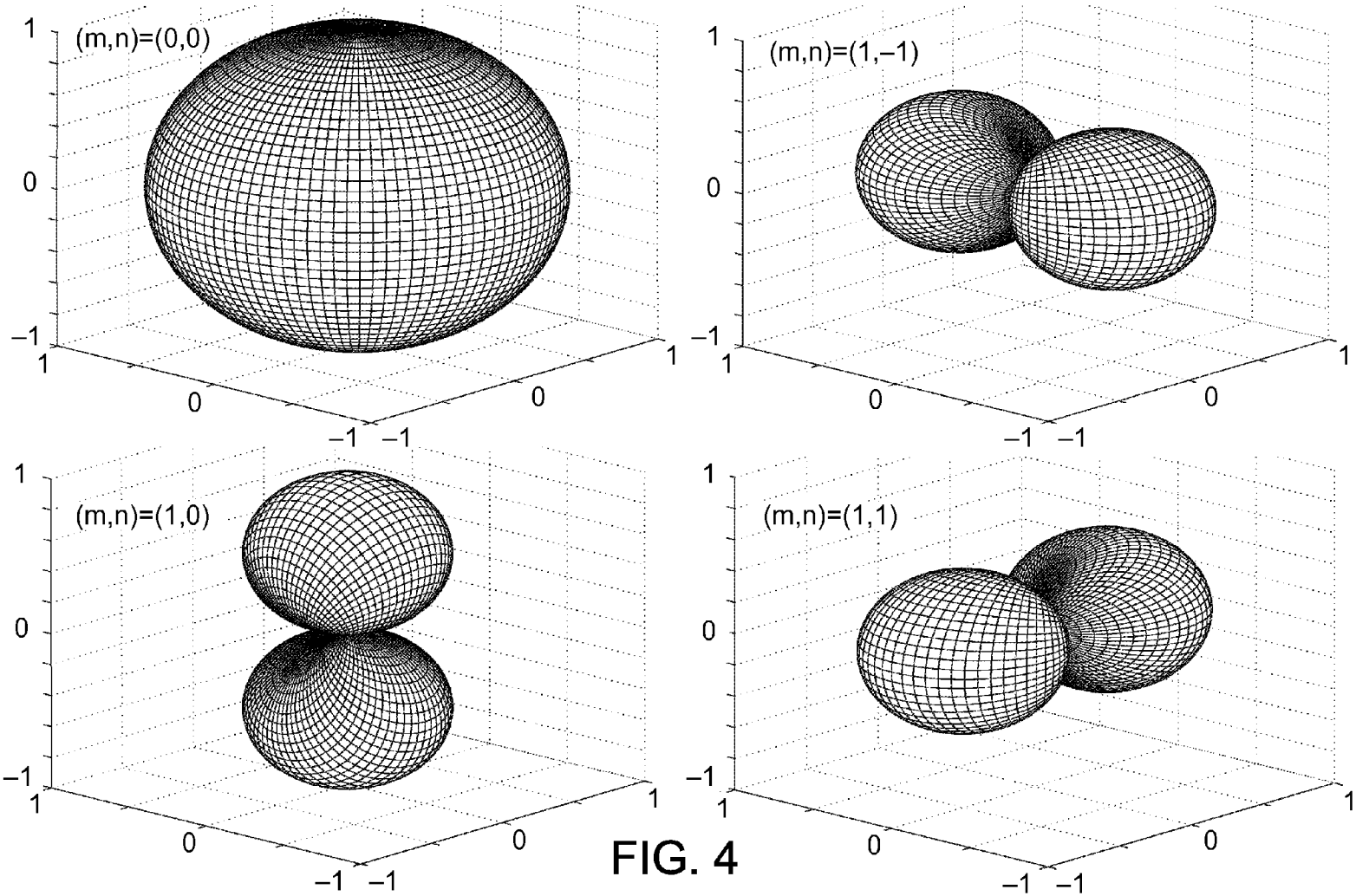
FIG. 4 shows examples of surface mesh plots of the magnitudes of spherical harmonic basis functions of order 0 and 1.

FIG. 4 shows examples of surface mesh plots of the magnitudes of spherical harmonic basis functions of degree 0 and 1. The magnitude of the function $Y_0^0$ is spherical and omnidirectional. The function $Y_1^{-1}$ has positive and negative spherical lobes extending in the +y and −y directions, respectively. The function $Y_1^0$ has positive and negative spherical lobes extending in the +z and −z directions, respectively. The function $Y_1^1$ has positive and negative spherical lobes extending in the +x and −x directions, respectively.

Figure 5:
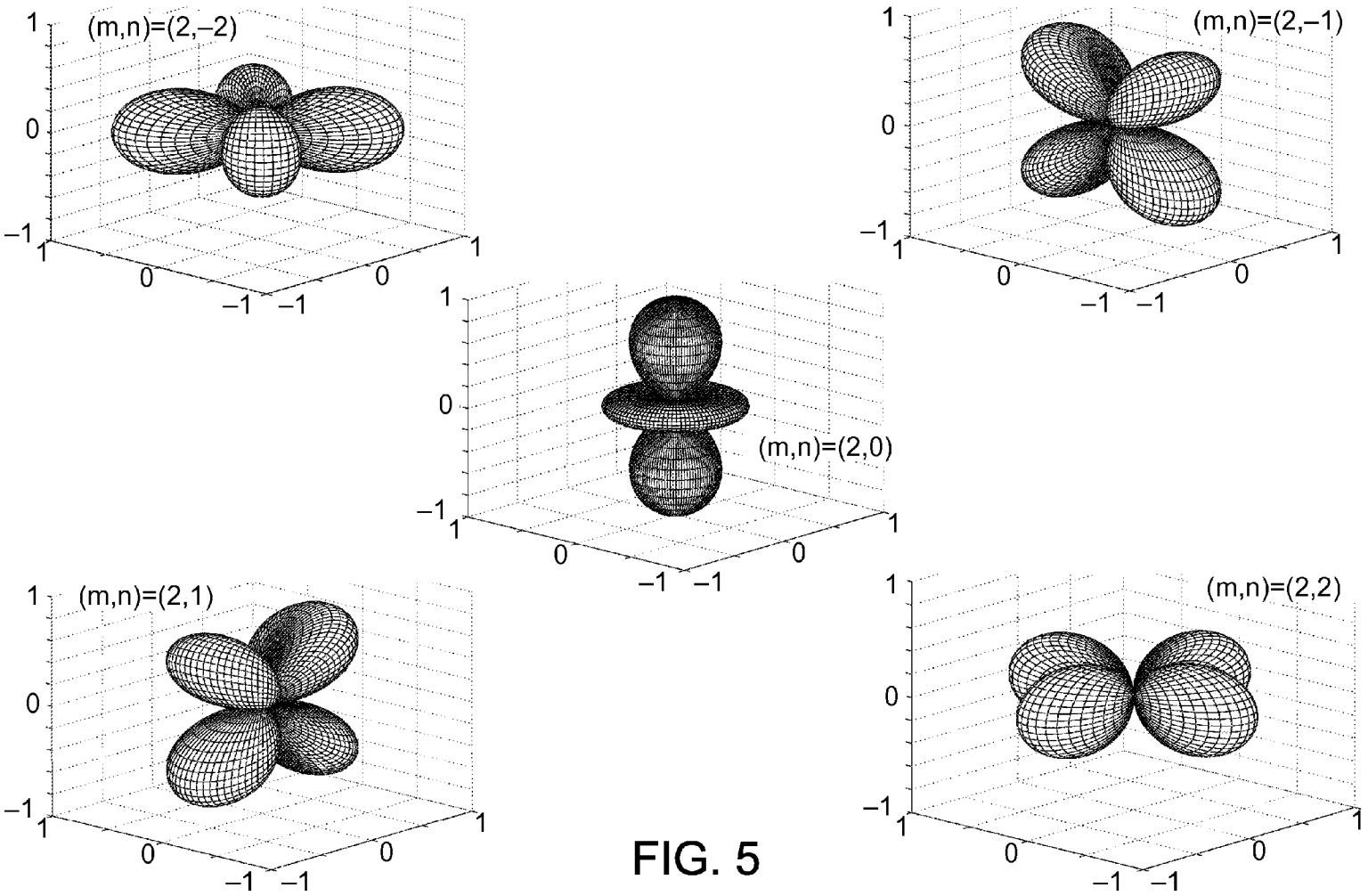
FIG. 5 shows examples of surface mesh plots of the magnitudes of spherical harmonic basis functions of order 2.

FIG. 5 shows examples of surface mesh plots of the magnitudes of spherical harmonic basis functions of degree 2. The functions $Y_2^{-2}$ and $Y_2^2$ have lobes extending in the x-y plane. The function $Y_2^{-1}$ has lobes extending in the y-z plane, and the function $Y_2^1$ has lobes extending in the x-z plane. The function $Y_2^0$ has positive lobes extending in the +z and −z directions and a toroidal negative lobe extending in the x-y plane.

The total number of SHC in the set may depend on various factors. For scene-based audio, for example, the total number of SHC may be constrained by the number of microphone transducers in the recording array. For channel- and object-based audio, the total number of SHC may be determined by the available bandwidth. In one example, a fourth-order representation involving 25 coefficients (i.e., $0 \le n \le 4$, $-n \le m \le +n$) for each frequency is used. Other examples of hierarchical sets that may be used with the approach described herein include sets of wavelet transform coefficients and other sets of coefficients of multiresolution basis functions.

A sound field may be represented in terms of SHC using an expression such as the following:

$$p_i(t, r_l, \theta_l, \varphi_l) = \sum_{\omega=0}^{\infty}\left[4\pi\sum_{n=0}^{\infty} j_n(kr_l)\sum_{m=-n}^{n} A_n^m(k)Y_n^m(\theta_l, \varphi_l)\right]e^{j\omega t}, \quad (2)$$

This expression shows that the pressure $p_i$ at any point $\{r_l,\theta_l,\phi_l\}$ of the sound field can be represented uniquely by the SHC $A_n^m(k)$. The SHC $A_n^m(k)$ can be derived from signals that are physically acquired (e.g., recorded) using any of various microphone array configurations, such as a tetrahedral or spherical microphone array. Input of this form represents scene-based audio input to a proposed encoder. In a non-limiting example, it is assumed that the inputs to the SHC encoder are the different output channels of a microphone array, such as an Eigenmike® (mh acoustics LLC, San Francisco, Calif.). One example of an Eigenmike® array is the em32 array, which includes 32 microphones arranged on the surface of a sphere of diameter 8.4 centimeters, such that each of the output signals $p_i(t)$, i=1 to 32, is the pressure recorded at time sample t by microphone i.

Alternatively, the SHC $A_n^m(k)$ can be derived from channel-based or object-based descriptions of the sound field. For example, the coefficients $A_n^m(k)$ for the sound field corresponding to an individual audio object may be expressed as $$A_n^m(k)=g(\omega)(-4\pi ik)h_n^{(2)}(kr_s)Y_n^{m*}(\theta_s,\phi_s), \tag{3}$$

where i is $\sqrt{-1}$ and $h_n^{(2)}(\bullet)$ is the spherical Hankel function (of the second kind) of order n, $\{r_s,\theta_s,\phi_s\}$ is the location of the object, and $g(\omega)$ is the source energy as a function of frequency. One of skill in the art will recognize that other representations of coefficients $A_n^m$ (or, equivalently, of corresponding time-domain coefficients $a_n^m$) may be used, such as representations that do not include the radial component.

Knowing the source energy $g(\omega)$ as a function of frequency allows us to convert each PCM object and its location $\{r_s,\theta_s,\phi_s\}$ into the SHC $A_n^m(k)$. This source energy may be obtained, for example, using time-frequency analysis techniques, such as by performing a fast Fourier transform (e.g., a 256-, 512-, or 1024-point FFT) on the PCM stream. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r,\theta_r,\phi_r\}$.

One of skill in the art will recognize that several slightly different definitions of spherical harmonic basis functions are known (e.g., real, complex, normalized (e.g., N3D), semi-normalized (e.g., SN3D), Furse-Malham (FuMa or FMH), etc.), and consequently that expression (1) (i.e., spherical harmonic decomposition of a sound field) and expression (2) (i.e., spherical harmonic decomposition of a sound field produced by a point source) may appear in the literature in slightly different form. The present description is not limited to any particular form of the spherical harmonic basis functions and indeed is generally applicable to other hierarchical sets of elements as well.

Figure 6B:
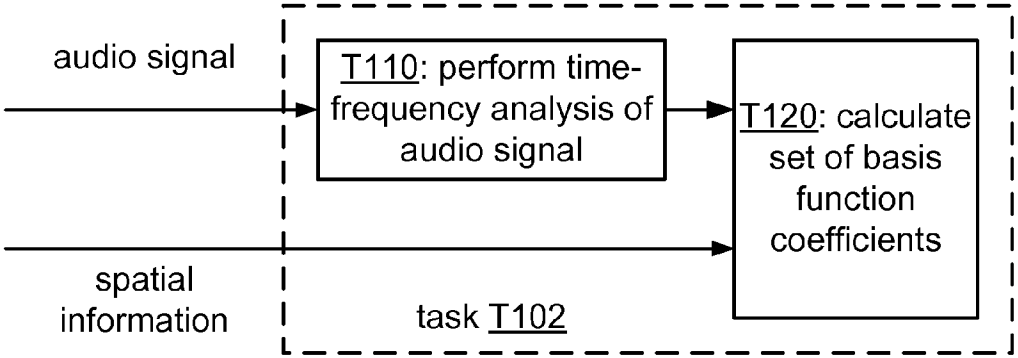
FIG. 6B shows a flowchart of an implementation T102 of task T100.
Figure 6C:
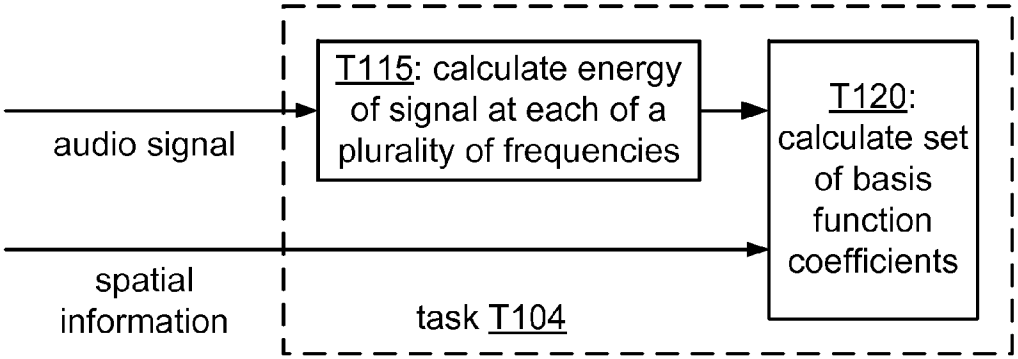
FIG. 6C shows a flowchart of an implementation T104 of task T100.
Figure 6A:
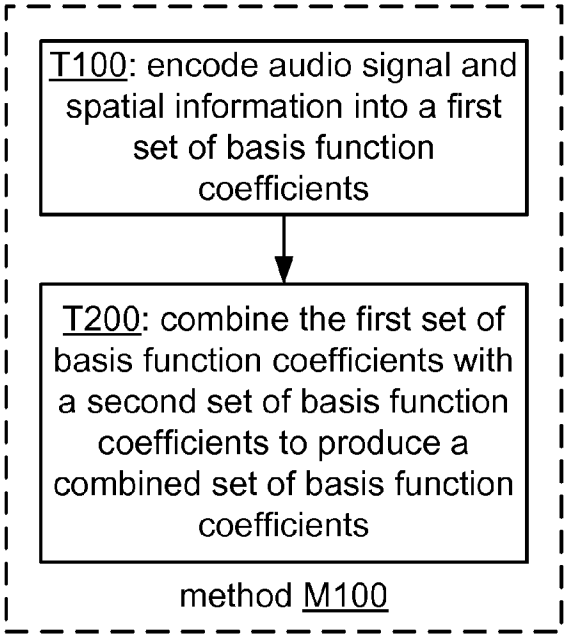
FIG. 6A shows a flowchart for a method M100 of audio signal processing according to a general configuration.

FIG. 6A shows a flowchart of a method M100 according to a general configuration that includes tasks T100 and T200. Task T100 encodes an audio signal (e.g., an audio stream of an audio object as described herein) and spatial information for the audio signal (e.g., from metadata of the audio object as described herein) into a first set of basis function coefficients that describes a first sound field. Task T200 combines the first set of basis function coefficients with a second set of basis function coefficients that describes a second sound field during a time interval (e.g., a set of SHC) to produce a combined set of basis function coefficients that describes a combined sound field during the time interval.

Task T100 may be implemented to perform a time-frequency analysis on the audio signal before calculating the coefficients. FIG. 6B shows a flowchart of such an implementation T102 of task T100 that includes subtasks T110 and T120. Task T110 performs a time-frequency analysis of the audio signal (e.g., a PCM stream). Based on the results of the analysis and on spatial information for the audio signal (e.g., location data, such as direction and/or distance), task T120 calculates the first set of basis function coefficients. FIG. 6C shows a flowchart of an implementation T104 of task T102 that includes an implementation T115 of task T110. Task T115 calculates an energy of the audio signal at each of a plurality of frequencies (e.g., as described herein with reference to source energy $g(\omega)$). In such case, task T120 may be implemented to calculate the first set of coefficients as, for example, a set of spherical harmonic coefficients (e.g., according to an expression such as expression (3) above). It may be desirable to implement task T115 to calculate phase information of the audio signal at each of the plurality of frequencies and to implement task T120 to calculate the set of coefficients according to this information as well.

Figure 7A:
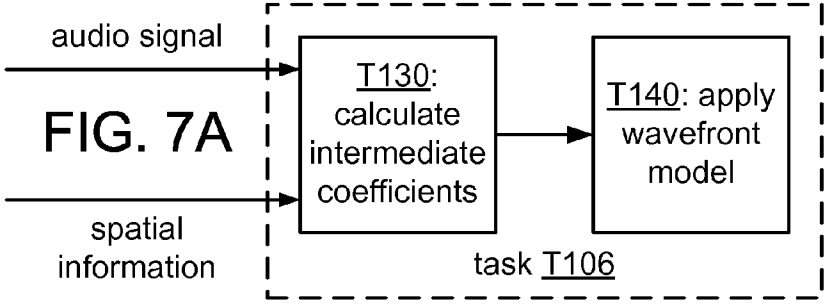
FIG. 7A shows a flowchart of an implementation T106 of task T100.

FIG. 7A shows a flowchart of an alternate implementation T106 of task T100 that includes subtasks T130 and T140. Task T130 performs an initial basis decomposition on the input signals to produce a set of intermediate coefficients. In one example, such a decomposition is expressed in the time domain as $$D_n^m(t)=\langle p_i(t),Y_n^m(\theta_i,\phi_i)\rangle, \tag{4}$$

where $D_n^m$ denotes the intermediate coefficient for time sample t, order n, and suborder m; and $Y_n^m(\theta_i,\theta_i)$ denotes the spherical basis function, at order n and suborder m, for the elevation $\theta_i$ and azimuth $\phi_i$ associated with input stream i (e.g., the elevation and azimuth of the normal to the sound-sensing surface of a corresponding microphone i). In a particular but non-limiting example, the maximum N of order n is equal to four, such that a set of twenty-five intermediate coefficients D is obtained for each time sample t. It is expressly noted that task T130 may also be performed in a frequency domain.

Task T140 applies a wavefront model to the intermediate coefficients to produce the set of coefficients. In one example, task T140 filters the intermediate coefficients in accordance with a spherical-wavefront model to produce a set of spherical harmonic coefficients. Such an operation may be expressed as $$a_n^m(t)=D_n^m(t)*q_{s,n}(t), \tag{5}$$

where $a_n^m(t)$ denotes the time-domain spherical harmonic coefficient at order n and suborder m for time sample t, $q_{s,n}(t)$ denotes the time-domain impulse response of a filter for order n for the spherical-wavefront model, and * is the time-domain convolution operator. Each filter $q_{s,n}(t)$, $1\le n\le N$, may be implemented as a finite-impulse-response filter. In one example, each filter $q_{s,n}(t)$ is implemented as an inverse Fourier transform of the frequency-domain filter $$\frac{1}{Q_{s,n}(\omega)}, \tag{6}$$

where $$Q_{s,n}(\omega)=\frac{-i}{(kr)^2 h_n^{(2)\prime}(kr)},$$

k is the wavenumber ($\omega/c$), r is the radius of the spherical region of interest (e.g., the radius of the spherical microphone array), and $h_n^{(2)\prime}$ denotes the derivative (with respect to r) of the spherical Hankel function of the second kind of order n.

In another example, task T140 filters the intermediate coefficients in accordance with a planar-wavefront model to produce the set of spherical harmonic coefficients. For example, such an operation may be expressed as $$b_n^m(t)=D_n^m(t)*q_{p,n}(t), \quad (7)$$

where $b_n^m(t)$ denotes the time-domain spherical harmonic coefficient at order n and suborder m for time sample t and $q_{p,n}(t)$ denotes the time-domain impulse response of a filter for order n for the planar-wavefront model. Each filter $q_{p,n}(t)$, $1 \le n \le N$, may be implemented as a finite-impulse-response filter. In one example, each filter $q_{p,n}(t)$ is implemented as an inverse Fourier transform of the frequency-domain filter $$\frac{1}{Q_{p,n}(\omega)}, \quad (8)$$

where $$Q_{p,n}(\omega) = \frac{(-1)^{n+1}}{(kr)^2 h_n^{(2)\prime}(kr)}.$$

It is expressly noted that either of these examples of task T140 may also be performed in a frequency domain (e.g., as a multiplication).

Figure 7B:
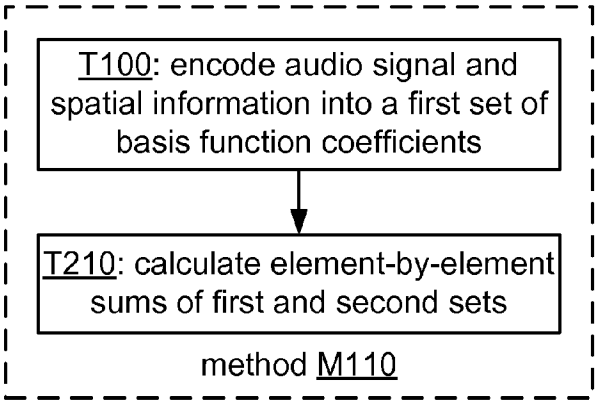
FIG. 7B shows a flowchart of an implementation M110 of method M100.

FIG. 7B shows a flowchart of an implementation M110 of method M100 that includes an implementation T210 of task T200. Task T210 combines the first and second sets of coefficients by calculating element-by-element sums (e.g., a vector sum) to produce the combined set. In another implementation, task T200 is implemented to concatenate the first and second sets instead.

Task T200 may be arranged to combine the first set of coefficients, as produced by task T100, with a second set of coefficients as produced by another device or process (e.g., an Ambisonics or other SHC bitstream). Alternatively or additionally, task T200 may be arranged to combine sets of coefficients produced by multiple instances of task T100 (e.g., corresponding to each of two or more audio objects). Accordingly, it may be desirable to implement method M100 to include multiple instances of task T100. FIG. 8 shows a flowchart of such an implementation M200 of method M100 that includes L instances T100*a*-T100L of task T100 (e.g., of task T102, T104, or T106). Method M110 also includes an implementation T202 of task T200 (e.g., of task T210) that combines the L sets of basis function coefficients (e.g., as element-by-element sums) to produce a combined set. Method M110 may be used, for example, to encode a set of L audio objects (e.g., as illustrated in FIG. 1A) into a combined set of basis function coefficients (e.g., SHC). FIG. 9 shows a flowchart of an implementation M210 of method M200 that includes an implementation T204 of task T202, which combines the sets of coefficients produced by tasks T100*a*-T100L with a set of coefficients (e.g., SHC) as produced by another device or process.

It is contemplated and hereby disclosed that the sets of coefficients combined by task T200 need not have the same number of coefficients. To accommodate a case in which one of the sets is smaller than another, it may be desirable to implement task T210 to align the sets of coefficients at the lowest-order coefficient in the hierarchy (e.g., at the coefficient corresponding to the spherical harmonic basis function $Y_0^0$).

The number of coefficients used to encode an audio signal (e.g., the number of the highest-order coefficient) may be different from one signal to another (e.g., from one audio object to another). For example, the sound field corresponding to one object may be encoded at a lower resolution than the sound field corresponding to another object. Such variation may be guided by factors that may include any one or more of, for example, the importance of the object to the presentation (e.g., a foreground voice vs. a background effect), location of the object relative to the listener's head (e.g., object to the side of the listener's head are less localizable than objects in front of the listener's head and thus may be encoded at a lower spatial resolution), and location of the object relative to the horizontal plane (e.g., the human auditory system has less localization ability outside this plane than within it, so that coefficients encoding information outside the plane may be less important than those encoding information within it).

In the context of unified spatial audio coding, channel-based signals (or loudspeaker feeds) are just audio signals (e.g., PCM feeds) in which the locations of the objects are the pre-determined positions of the loudspeakers. Thus channel-based audio can be treated as just a subset of object-based audio, in which the number of objects is fixed to the number of channels and the spatial information is implicit in the channel identification (e.g., L, C, R, Ls, Rs, LFE).

Figure 7C:
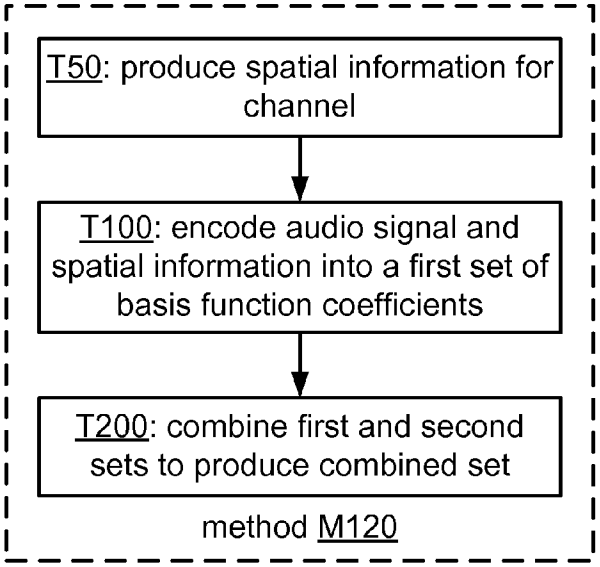
FIG. 7C shows a flowchart of an implementation M120 of method M100.

FIG. 7C shows a flowchart of an implementation M120 of method M100 that includes a task T50. Task T50 produces spatial information for a channel of a multichannel audio input. In this case, task T100 (e.g., task T102, T104, or T106) is arranged to receive the channel as the audio signal to be encoded with the spatial information. Task T50 may be implemented to produce the spatial information (e.g., the direction or location of a corresponding loudspeaker, relative to a reference direction or point) based on the format of the channel-based input. For a case in which only one channel format will be processed (e.g., only 5.1, or only 7.1), task T130 may be configured to produce a corresponding fixed direction or location for the channel. For a case in which multiple channel formats will be accommodated, task T130 may be implemented to produce the spatial information for the channel according to a format identifier (e.g., indicating 5.1, 7.1, or 22.2 format). The format identifier may be received as metadata, for example, or as an indication of the number of input PCM streams that are currently active.

Figure 10:
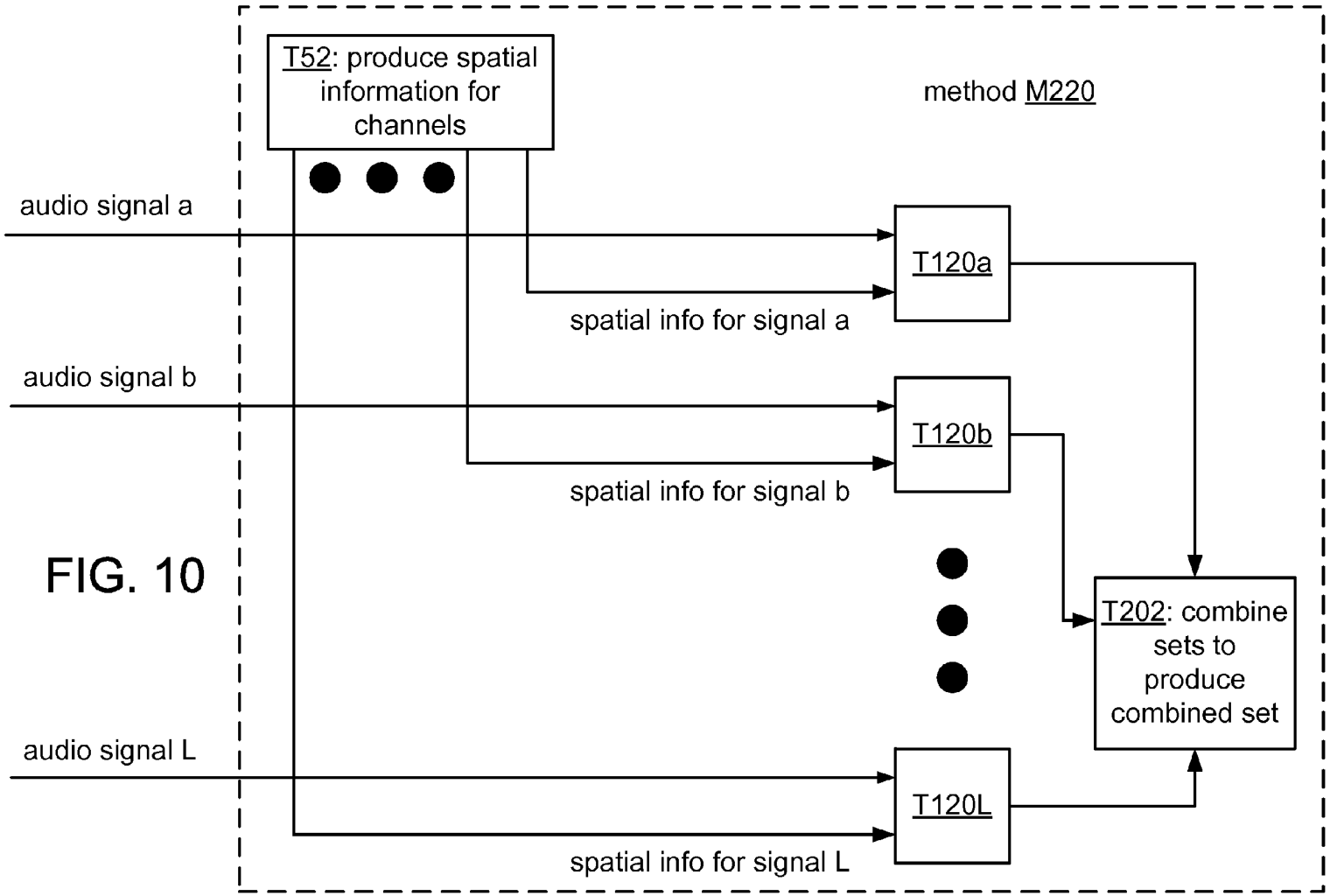
FIG. 10 shows a flowchart of an implementation M220 of method M200.

FIG. 10 shows a flowchart of an implementation M220 of method M200 that includes an implementation T52 of task T50, which produces spatial information for each channel (e.g., the direction or location of a corresponding loudspeaker), based on the format of the channel-based input, to encoding tasks T120*a*-T120L. For a case in which only one channel format will be processed (e.g., only 5.1, or only 7.1), task T52 may be configured to produce a corresponding fixed set of location data. For a case in which multiple channel formats will be accommodated, task T52 may be implemented to produce the location data for each channel according to a format identifier as described above. Method M220 may also be implemented such that task T202 is an instance of task T204.

In a further example, method M220 is implemented such that task T52 detects whether an audio input signal is channel-based or object-based (e.g., as indicated by a format of the input bitstream) and configures each of tasks T120*a*-L accordingly to use spatial information from task T52 (for channel-based input) or from the audio input (for object-based input). In another further example, a first instance of method M200 for processing object-based input and a second instance of method M200 (e.g., of M220) for processing channel-based input share a common instance of combining task T202 (or T204), such that the sets of coefficients calculated from the object-based and the channel-based inputs are combined (e.g., as a sum at each coefficient order) to produce the combined set of coefficients.

Figure 7D:
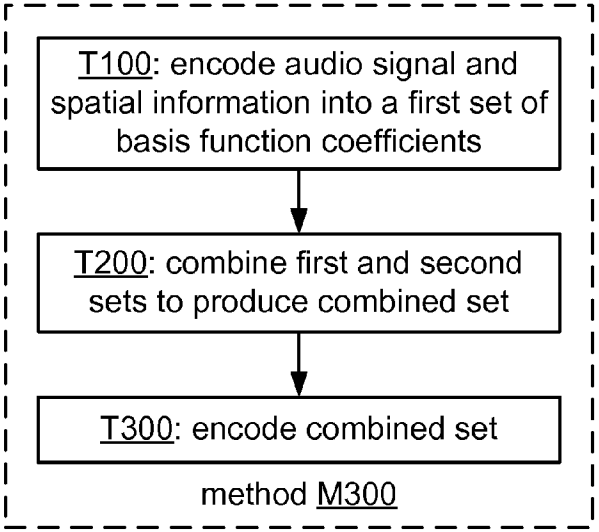
FIG. 7D shows a flowchart of an implementation M300 of method M100.

FIG. 7D shows a flowchart of an implementation M300 of method M100 that includes a task T300. Task T300 encodes the combined set (e.g., for transmission and/or storage). Such encoding may include bandwidth compression. Task T300 may be implemented to encode the set by applying one or more lossy or lossless coding techniques, such as quantization (e.g., into one or more codebook indices), error correction coding, redundancy coding, etc., and/or packetization. Additionally or alternatively, such encoding may include encoding into an Ambisonic format, such as B-format, G-format, or Higher-order Ambisonics (HOA). In one example, task T300 is implemented to encode the coefficients into HOA B-format and then to encode the B-format signals using Advanced Audio Coding (AAC; e.g., as defined in ISO/IEC 14496-3:2009, "Information technology—Coding of audio-visual objects—Part 3: Audio," Int'l Org. for Standardization, Geneva, CH). Descriptions of other methods for encoding sets of SHC that may be performed by task T300 may be found, for example, in U.S. Publ. Pat. Appls. Nos. 2012/0155653 A1 (Jax et al.) and 2012/0314878 A1 (Daniel et al.). Task T300 may be implemented, for example, to encode the set of coefficients as differences between coefficients of different orders and/or differences between coefficients of the same order at different times.

Any of the implementations of methods M200, M210, and M220 as described herein may also be implemented as implementations of method M300 (e.g., to include an instance of task T300). It may be desirable to implement MPEG encoder MP10 as shown in FIG. 3B to perform an implementation of method M300 as described herein (e.g., to produce a bitstream for streaming, broadcast, multicast, and/or media mastering (for example, mastering of CD, DVD, and/or Blu-Ray® Disc)).

In another example, task T300 is implemented to perform a transform (e.g., using an invertible matrix) on a basic set of the combined set of coefficients to produce a plurality of channel signals, each associated with a corresponding different region of space (e.g., a corresponding different loudspeaker location). For example, task T300 may be implemented to apply an invertible matrix to convert a set of five low-order SHC (e.g., coefficients that correspond to basis functions that are concentrated in the 5.1 rendering plane, such as (m,n)=[(1,−1), (1,1), (2,−2), (2,2)], and the omnidirectional coefficient (m,n)=(0,0)) into the five full-band audio signals in the 5.1 format. The desire for invertibility is to allow conversion of the five full-band audio signals back to the basic set of SHC with little or no loss of resolution. Task T300 may be implemented to encode the resulting channel signals using a backward-compatible codec such as, for example, AC3 (e.g., as described in ATSC Standard: Digital Audio Compression, Doc. A/52:2012, 23 Mar. 2012, Advanced Television Systems Committee, Washington, D.C.; also called ATSC A/52 or Dolby Digital, which uses lossy MDCT compression), Dolby TrueHD (which includes lossy and lossless compression options), DTS-HD Master Audio (which also includes lossy and lossless compression options), and/or MPEG Surround (MPS, ISO/IEC 14496-3, also called High-Efficiency Advanced Audio Coding or HeAAC). The rest of the set of coefficients may be encoded into an extension portion of the bitstream (e.g., into "aux-data" portions of AC3 packets, or extension packets of a Dolby Digital Plus bitstream).

Figure 8B:
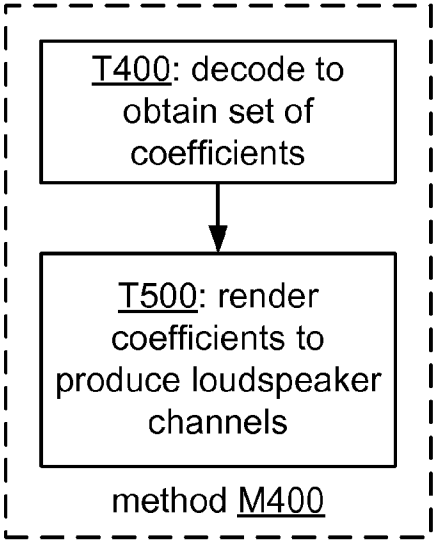
FIG. 8B shows a flowchart for a method M400 of audio signal processing according to a general configuration.
Figure 8A:
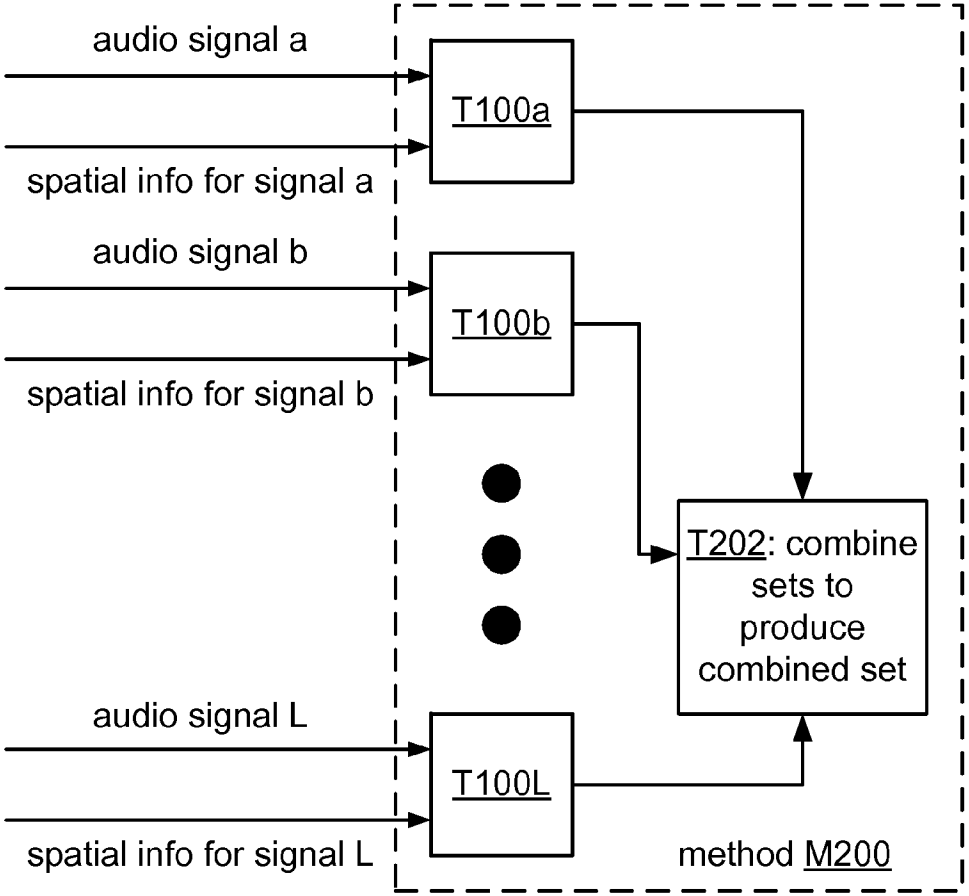
FIG. 8A shows a flowchart of an implementation M200 of method M100.
Figure 9:
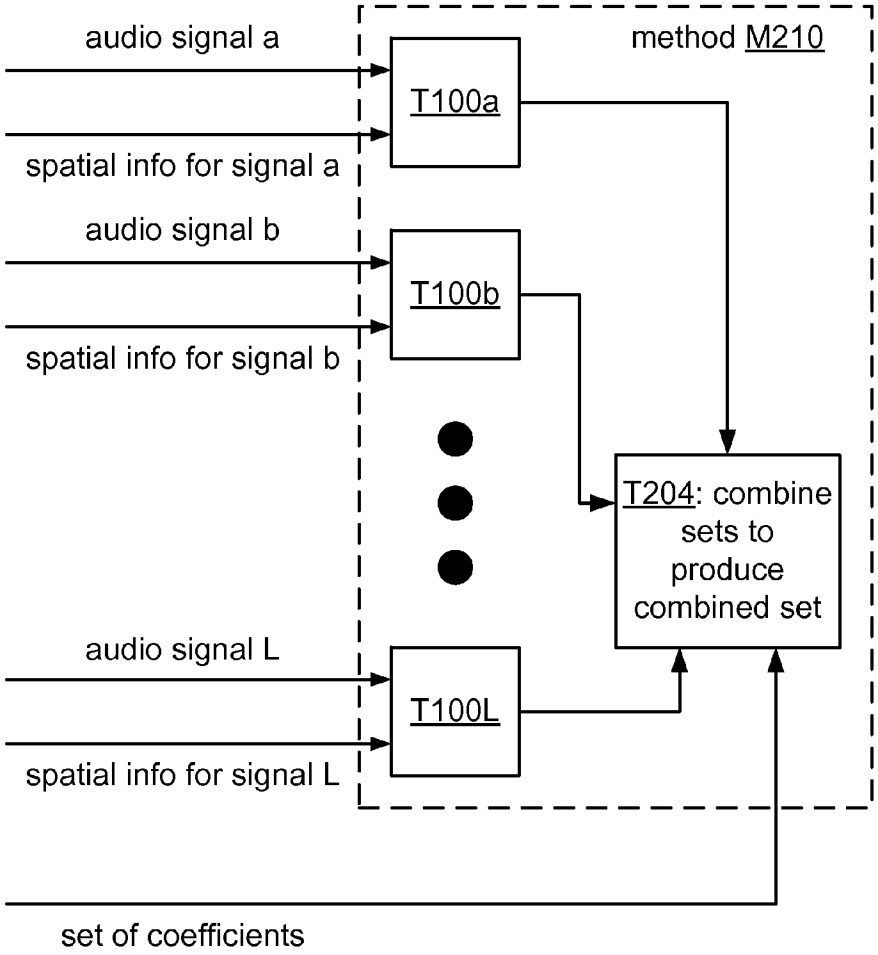
FIG. 9 shows a flowchart of an implementation M210 of method M200.

FIG. 8B shows a flowchart for a method M400 of decoding, according to a general configuration, that corresponds to method M300 and includes tasks T400 and T500. Task T400 decodes a bitstream (e.g., as encoded by task T300) to obtain a combined set of coefficients. Based on information relating to a loudspeaker array (e.g., indications of the number of the loudspeakers and their positions and radiation patterns), task T500 renders the coefficients to produce a set of loudspeaker channels. The loudspeaker array is driven according to the set of loudspeaker channels to produce a sound field as described by the combined set of coefficients.

One possible method for determining a matrix for rendering the SHC to a desired loudspeaker array geometry is an operation known as 'mode-matching.' Here, the loudspeaker feeds are computed by assuming that each loudspeaker produces a spherical wave. In such a scenario, the pressure (as a function of frequency) at a certain position r,θ,φ, due to the l-th loudspeaker, is given by $$P_l(\omega, r, \theta, \varphi) = g_l(\omega)\sum_{n=0}^{\infty} j_n(kr)\sum_{m=-n}^{n}(-4\pi ik)h_n^{(2)}(kr_l)Y_n^{m*}(\theta_l, \varphi_l)Y_n^m(\theta, \varphi), \tag{9}$$

where $\{r_l,\theta_l,\phi_l\}$ represents the position of the f-th loudspeaker and $g_l(\omega)$ is the loudspeaker feed of the f-th speaker (in the frequency domain). The total pressure $P_t$ due to all L speakers is thus given by $$P_t(\omega, r, \theta, \varphi) = \sum_{l=1}^{L} g_l(\omega)\sum_{n=0}^{\infty} j_n(kr)\sum_{m=-n}^{n}(-4\pi ik)h_n^{(2)}(kr_l)Y_n^{m*}(\theta_l, \varphi_l)Y_n^m(\theta, \varphi). \tag{10}$$

We also know that the total pressure in terms of the SHC is given by the equation $$P_t(\omega, r, \theta, \varphi) = 4\pi\sum_{n=0}^{\infty} j_n(kr)\sum_{m=-n}^{n} A_n^m(k)Y_n^m(\theta, \varphi). \tag{11}$$

Equating the above two equations allows us to use a transform matrix to express the loudspeaker feeds in terms of the SHC as follows:

$$\begin{bmatrix} A_0^0(\omega) \\ A_1^1(\omega) \\ A_1^{-1}(\omega) \\ A_2^2(\omega) \\ A_2^{-2}(\omega) \end{bmatrix} = -ik\begin{bmatrix} h_0^{(2)}(kr_1)Y_0^{0*}(\theta_1, \varphi_1) & h_0^{(2)}(kr_2)Y_0^{0*}(\theta_2, \varphi_2). & \dots & \dots & \dots \\ h_1^{(2)}(kr_1)Y_1^{1*}(\theta_1, \varphi_1). & \dots & \dots & \dots & \dots \\ \dots & \dots & \dots & \dots & \dots \\ \dots & \dots & \dots & \dots & \dots \\ \dots & \dots & \dots & \dots & \dots \end{bmatrix} \tag{12}$$

-continued $$\begin{bmatrix} g_1(\omega) \\ g_2(\omega) \\ g_3(\omega) \\ g_4(\omega) \\ g_5(\omega) \end{bmatrix}.$$

This expression shows that there is a direct relationship between the loudspeaker feeds and the chosen SHC. The transform matrix may vary depending on, for example, which coefficients were used and which definition of the spherical harmonic basis functions is used. Although for convenience this example shows a maximum N of order n equal to two, it is expressly noted that any other maximum order may be used as desired for the particular implementation (e.g., four or more). In a similar manner, a transform matrix to convert from a selected basic set to a different channel format (e.g., 7.1, 22.2) may be constructed. While the above transformation matrix was derived from a 'mode matching' criteria, alternative transform matrices can be derived from other criteria as well, such as pressure matching, energy matching, etc. Although expression (12) shows the use of complex basis functions (as demonstrated by the complex conjugates), use of a real-valued set of spherical harmonic basis functions instead is also expressly disclosed.

Figure 11:
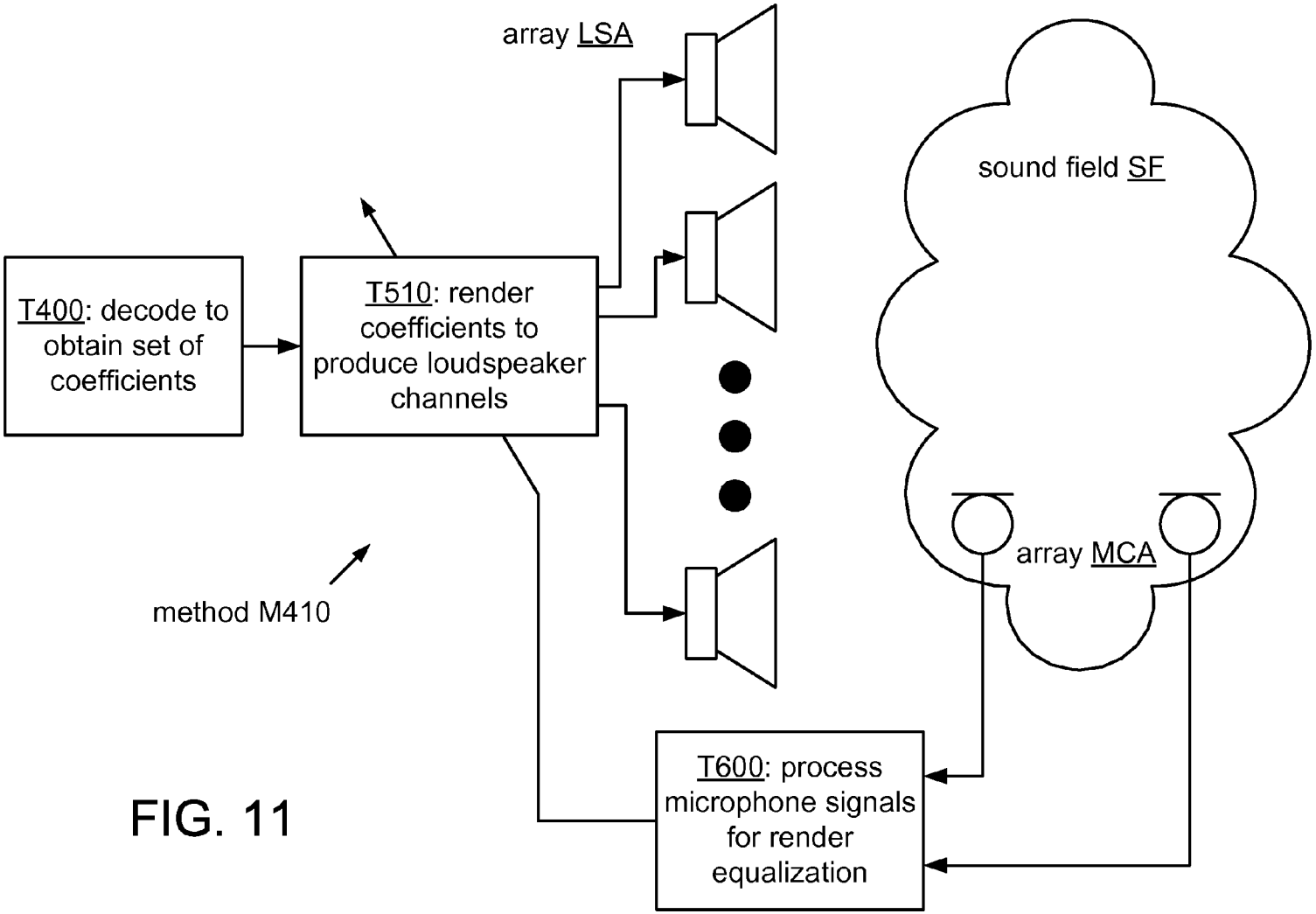
FIG. 11 shows a flowchart of an implementation M410 of method M400.

FIG. 11 shows a flowchart for an implementation M410 of method M400 that includes a task T600 and an adaptive implementation T510 of task T500. In this example, an array MCA of one or more microphones are arranged within the sound field SF produced by loudspeaker array LSA, and task T600 processes the signals produced by these microphones in response to the sound field to perform adaptive equalization of rendering task T510 (e.g., local equalization based on spatio-temporal measurements and/or other estimation techniques).

Potential advantages of such a representation using sets of coefficients of a set of orthogonal basis functions (e.g., SHC) include one or more of the following:

i. The coefficients are hierarchical. Thus, it is possible to send or store up to a certain truncated order (say n=N) to satisfy bandwidth or storage requirements. If more bandwidth becomes available, higher-order coefficients can be sent and/or stored. Sending more coefficients (of higher order) reduces the truncation error, allowing better-resolution rendering.

ii. The number of coefficients is independent of the number of objects—meaning that it is possible to code a truncated set of coefficients to meet the bandwidth requirement, no matter how many objects are in the sound-scene.

iii. The conversion of the PCM object to the SHC is not reversible (at least not trivially). This feature may allay fears from content providers who are concerned about allowing undistorted access to their copyrighted audio snippets (special effects), etc.

iv. Effects of room reflections, ambient/diffuse sound, radiation patterns, and other acoustic features can all be incorporated into the $A_n'''(k)$ coefficient-based representation in various ways.

v. The $A_n'''(k)$ coefficient-based sound field/surround-sound representation is not tied to particular loudspeaker geometries, and the rendering can be adapted to any loudspeaker geometry. Various additional rendering technique options can be found in the literature, for example.

vi. The SHC representation and framework allows for adaptive and non-adaptive equalization to account for acoustic spatio-temporal characteristics at the rendering scene (e.g., see method M410).

An approach as described herein may be used to provide a transformation path for channel- and/or object-based audio that allows a unified encoding/decoding engine for all three formats: channel-, scene-, and object-based audio. Such an approach may be implemented such that the number of transformed coefficients is independent of the number of objects or channels. Such an approach can also be used for either channel- or object-based audio even when an unified approach is not adopted. The format may be implemented to be scalable in that the number of coefficients can be adapted to the available bit-rate, allowing a very easy way to trade-off quality with available bandwidth and/or storage capacity.

The SHC representation can be manipulated by sending more coefficients that represent the horizontal acoustic information (for example, to account for the fact that human hearing has more acuity in the horizontal plane than the elevation/height plane). The position of the listener's head can be used as feedback to both the renderer and the encoder (if such a feedback path is available) to optimize the perception of the listener (e.g., to account for the fact that humans have better spatial acuity in the frontal plane). The SHC may be coded to account for human perception (psychoacoustics), redundancy, etc. As shown in method M410, for example, an approach as described herein may be implemented as an end-to-end solution (including final equalization in the vicinity of the listener) using, e.g., spherical harmonics.

Figure 12B:
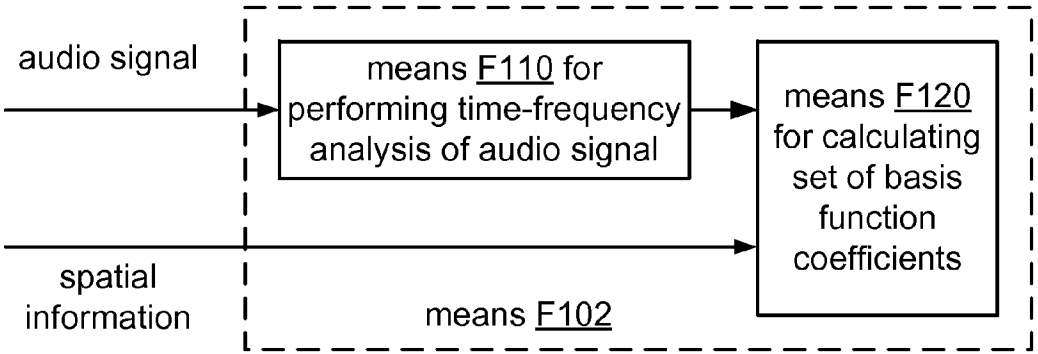
FIG. 12B shows a block diagram of an implementation F102 of means F100.
Figure 12C:
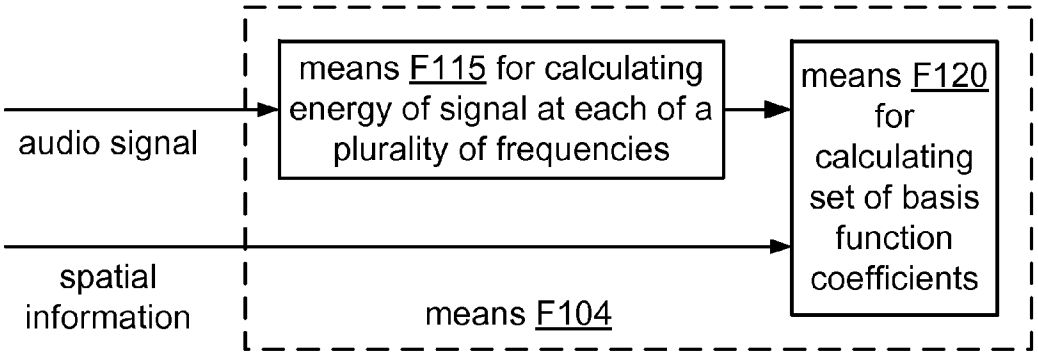
FIG. 12C shows a block diagram of an implementation F104 of means F100.
Figure 12A:
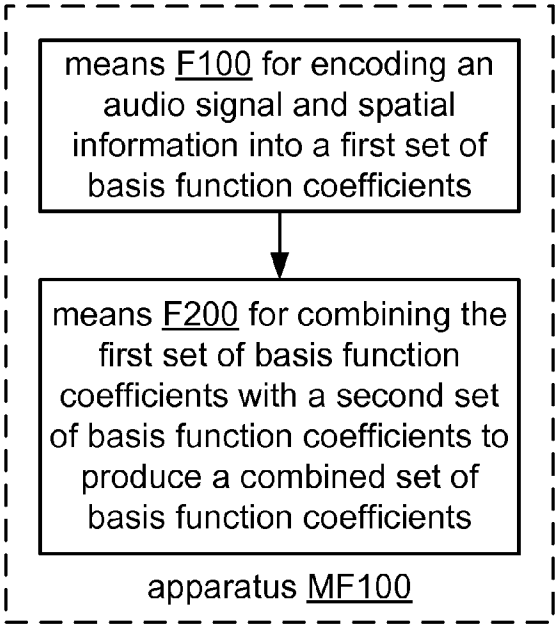
FIG. 12A shows a block diagram of an apparatus MF100 for audio signal processing according to a general configuration.

FIG. 12A shows a block diagram of an apparatus MF100 according to a general configuration. Apparatus MF100 includes means F100 for encoding an audio signal and spatial information for the audio signal into a first set of basis function coefficients that describes a first sound field (e.g., as described herein with reference to implementations of task T100). Apparatus MF100 also includes means F200 for combining the first set of basis function coefficients with a second set of basis function coefficients that describes a second sound field during a time interval to produce a combined set of basis function coefficients that describes a combined sound field during the time interval (e.g., as described herein with reference to implementations of task T100).

FIG. 12B shows a block diagram of an implementation F102 of means F100. Means F102 includes means F110 for performing time-frequency analysis of the audio signal (e.g., as described herein with reference to implementations of task T110). Means F102 also includes means F120 for calculating the set of basis function coefficients (e.g., as described herein with reference to implementations of task T120). FIG. 12C shows a block diagram of an implementation F104 of means F102 in which means F110 is implemented as means F115 for calculating energy of the audio signal at each of a plurality of frequencies (e.g., as described herein with reference to implementations of task T115).

Figure 13A:
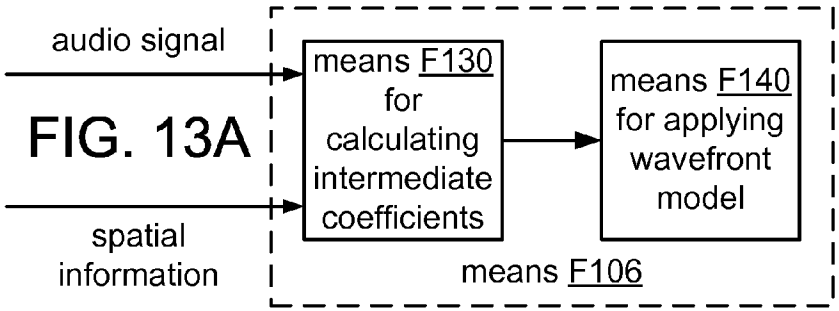
FIG. 13A shows a block diagram of an implementation F106 of task F100.

FIG. 13A shows a block diagram of an implementation F106 of means F100. Means F106 includes means F130 for calculating intermediate coefficients (e.g., as described herein with reference to implementations of task T130). Means F106 also includes means F140 for applying a wavefront model to the intermediate coefficients (e.g., as described herein with reference to implementations of task T140).

Figure 13B:
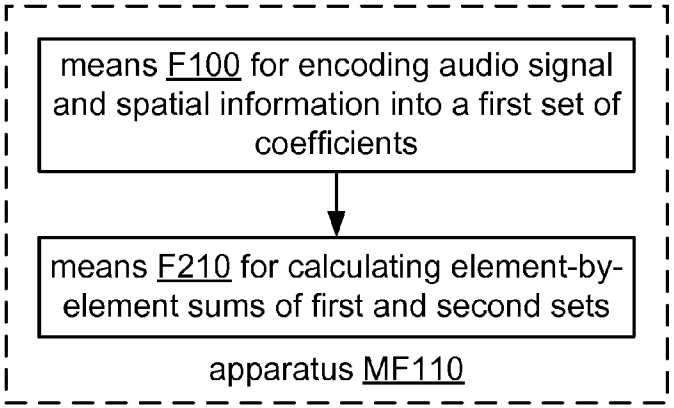
FIG. 13B shows a block diagram of an implementation MF110 of apparatus MF100.

FIG. 13B shows a block diagram of an implementation MF110 of apparatus MF100 in which means F200 is implemented as means F210 for calculating element-by-element sums of the first and second sets of basis function coefficients (e.g., as described herein with reference to implementations of task T210).

Figure 13C:
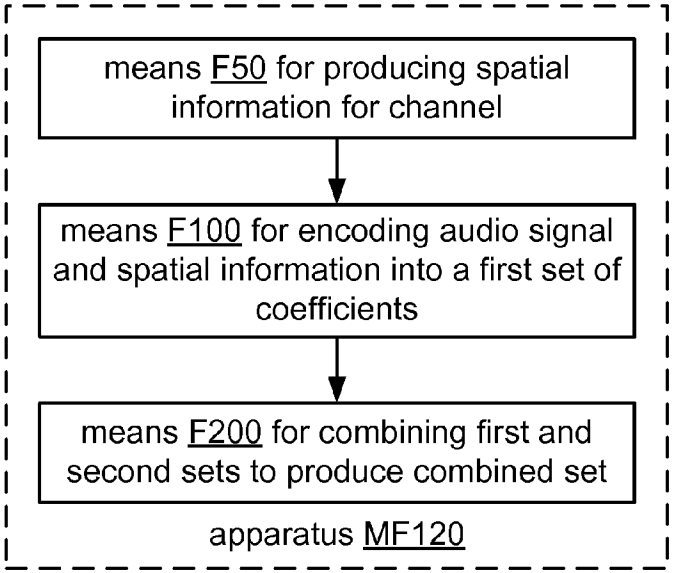
FIG. 13C shows a block diagram of an implementation MF120 of apparatus MF100.

FIG. 13C shows a block diagram of an implementation MF120 of apparatus MF100. Apparatus MF120 includes means F50 for producing spatial information for a channel of a multichannel audio input (e.g., as described herein with reference to implementations of task T50).

Figure 13D:
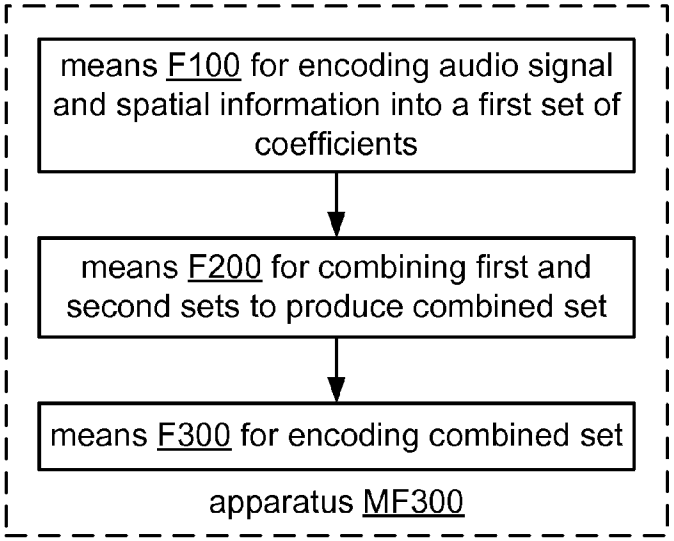
FIG. 13D shows a block diagram of an implementation MF300 of apparatus MF100.

FIG. 13D shows a block diagram of an implementation MF300 of apparatus MF100. Apparatus MF300 includes means F300 for encoding the combined set of basis function coefficients (e.g., as described herein with reference to implementations of task T300). Apparatus MF300 may also be implemented to include an instance of means F50.

Figure 14B:
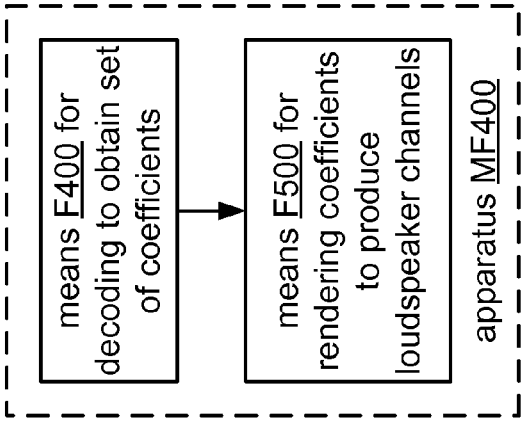
FIG. 14B shows a block diagram for an apparatus MF400 of audio signal processing according to a general configuration.
Figure 14C:
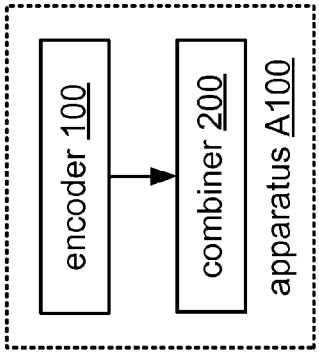
FIG. 14C shows a block diagram of an apparatus A100 for audio signal processing according to a general configuration.
Figure 14A:
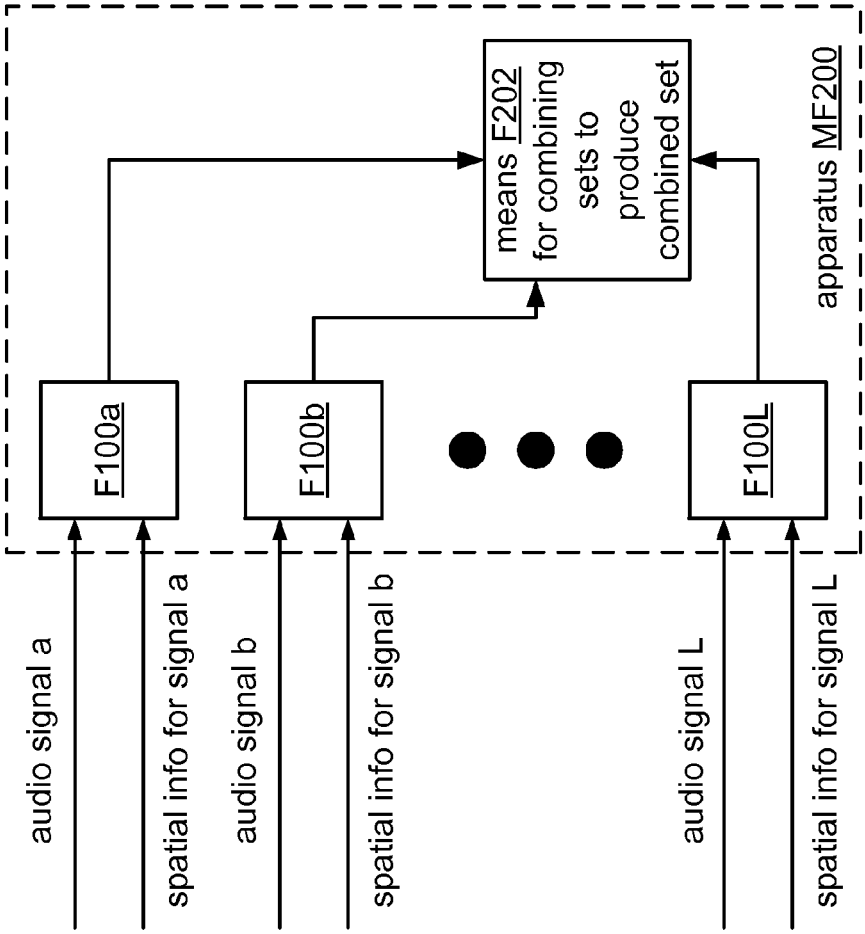
FIG. 14A shows a block diagram of an implementation MF200 of apparatus MF100.

FIG. 14A shows a block diagram of an implementation MF200 of apparatus MF100. Apparatus MF200 includes multiple instances F100*a*-F100L of means F100 and an implementation F202 of means F200 for combining sets of basis function coefficients produced by means F100*a*-F100L (e.g., as described herein with reference to implementations of method M200 and task T202).

FIG. 14B shows a block diagram of an apparatus MF400 according to a general configuration. Apparatus MF400 includes means F400 for decoding a bitstream to obtain a combined set of basis function coefficients (e.g., as described herein with reference to implementations of task T400). Apparatus MF400 also includes means F500 for rendering coefficients of the combined set to produce a set of loudspeaker channels (e.g., as described herein with reference to implementations of task T500).

FIG. 14C shows a block diagram of an apparatus A100 according to a general configuration. Apparatus A100 includes an encoder 100 configured to encode an audio signal and spatial information for the audio signal into a first set of basis function coefficients that describes a first sound field (e.g., as described herein with reference to implementations of task T100). Apparatus A100 also includes a combiner 200 configured to combine the first set of basis function coefficients with a second set of basis function coefficients that describes a second sound field during a time interval to produce a combined set of basis function coefficients that describes a combined sound field during the time interval (e.g., as described herein with reference to implementations of task T100).

Figure 15A:
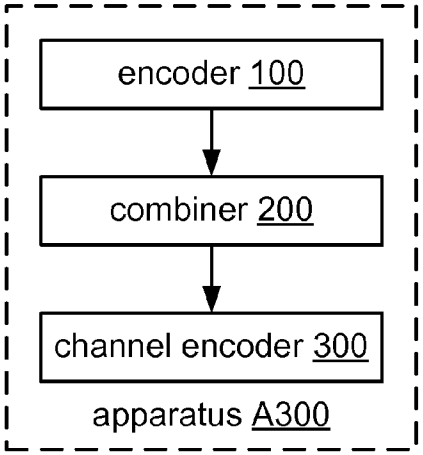
FIG. 15A shows a block diagram of an implementation A300 of apparatus A100.

FIG. 15A shows a block diagram of an implementation A300 of apparatus A100. Apparatus A300 includes a channel encoder 300 configured to encode the combined set of basis function coefficients (e.g., as described herein with reference to implementations of task T300). Apparatus A300 may also be implemented to include an instance of angle indicator 50 as described below.

Figure 15B:
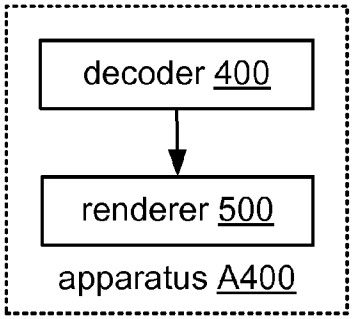
FIG. 15B shows a block diagram for an apparatus A400 of audio signal processing according to a general configuration.

FIG. 15B shows a block diagram of an apparatus MF400 according to a general configuration. Apparatus MF400 includes means F400 for decoding a bitstream to obtain a combined set of basis function coefficients (e.g., as described herein with reference to implementations of task T400). Apparatus MF400 also includes means F500 for rendering coefficients of the combined set to produce a set of loudspeaker channels (e.g., as described herein with reference to implementations of task T500).

Figure 15C:
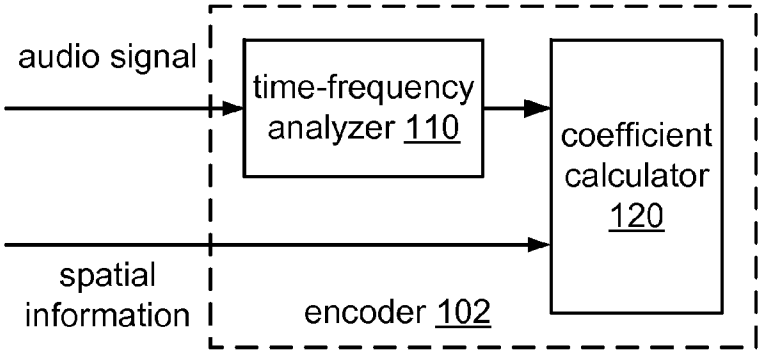
FIG. 15C shows a block diagram of an implementation 102 of encoder 100.
Figure 15D:
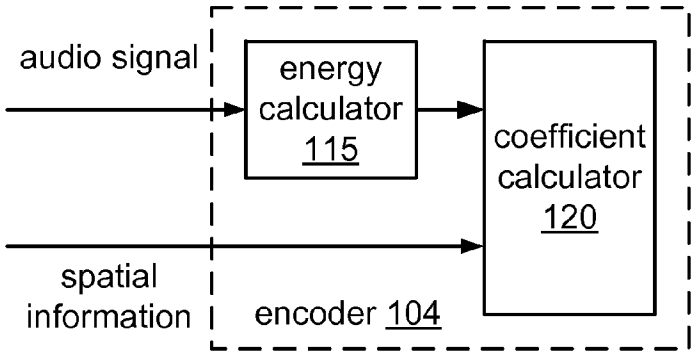
FIG. 15D shows a block diagram of an implementation 104 of encoder 100.

FIG. 15C shows a block diagram of an implementation 102 of encoder 100. Encoder 102 includes a time-frequency analyzer 110 configured to perform time-frequency analysis of the audio signal (e.g., as described herein with reference to implementations of task T110). Encoder 102 also includes a coefficient calculator 120 configured to calculate the set of basis function coefficients (e.g., as described herein with reference to implementations of task T120). FIG. 15D shows a block diagram of an implementation 104 of encoder 102 in which analyzer 110 is implemented as an energy calculator 115 configured to calculate energy of the audio signal at each of a plurality of frequencies (e.g., by performing a fast Fourier transform on the signal, as described herein with reference to implementations of task T115).

Figure 15E:
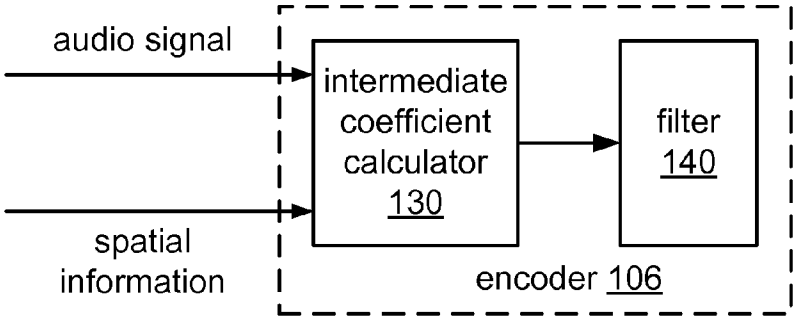
FIG. 15E shows a block diagram of an implementation 106 of encoder 100.

FIG. 15E shows a block diagram of an implementation 106 of encoder 100. Encoder 106 includes an intermediate coefficient calculator 130 configured to calculate intermediate coefficients (e.g., as described herein with reference to implementations of task T130). Encoder 106 also includes a filter 140 configured to apply a wavefront model to the intermediate coefficients to produce the first set of basis function coefficients (e.g., as described herein with reference to implementations of task T140).

Figure 16C:
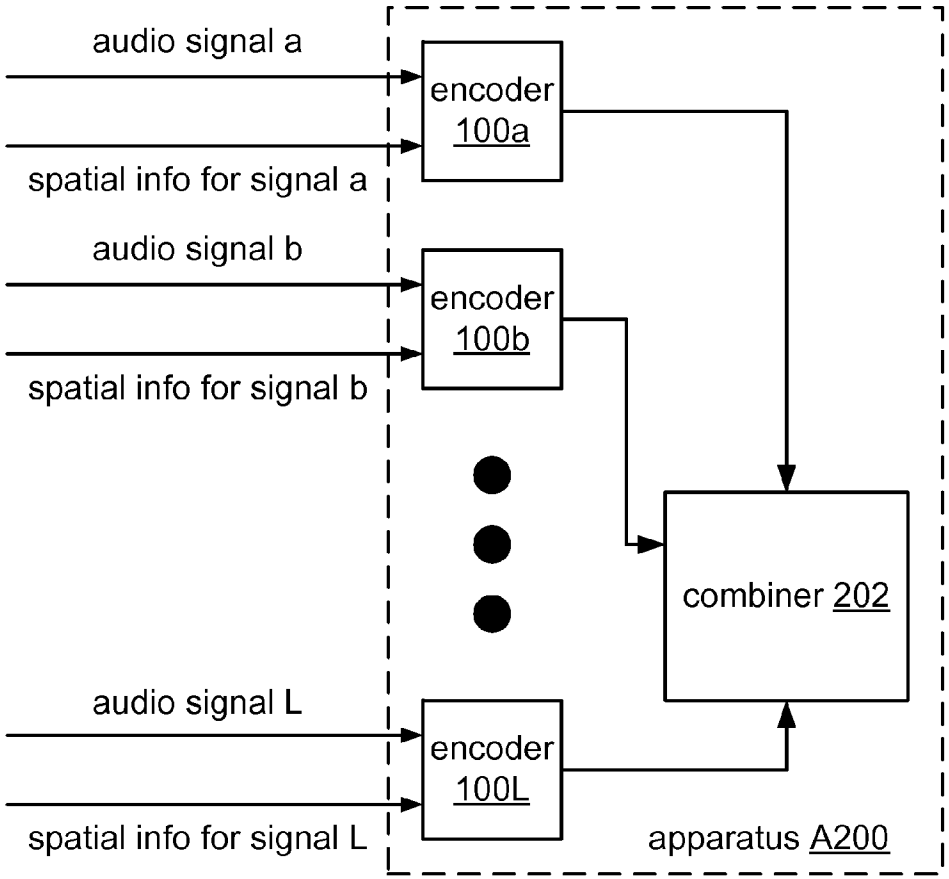
FIG. 16C shows a block diagram of an implementation A200 of apparatus A100.
Figure 16A:
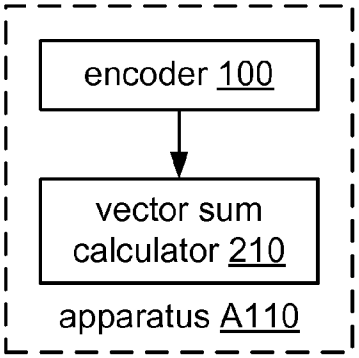
FIG. 16A shows a block diagram of an implementation A110 of apparatus A100.

FIG. 16A shows a block diagram of an implementation A110 of apparatus A100 in which combiner 200 is implemented as a vector sum calculator 210 configured to calculate element-by-element sums of the first and second sets of basis function coefficients (e.g., as described herein with reference to implementations of task T210).

Figure 16B:
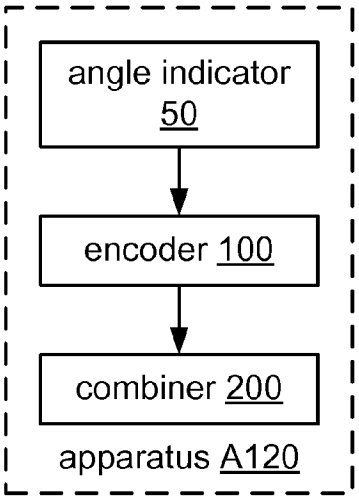
FIG. 16B shows a block diagram of an implementation A120 of apparatus A100.

FIG. 16B shows a block diagram of an implementation A120 of apparatus A100. Apparatus A120 includes an angle indicator 50 configured to produce spatial information for a channel of a multichannel audio input (e.g., as described herein with reference to implementations of task T50).

FIG. 16C shows a block diagram of an implementation A200 of apparatus A100. Apparatus A200 includes multiple instances 100*a*-100L of encoder 100 and an implementation 202 of combiner 200 configured to combine sets of basis function coefficients produced by encoders 100*a*-100L (e.g., as described herein with reference to implementations of method M200 and task T202). Apparatus A200 may also include a channel location data producer configured to produce corresponding location data for each stream, if the input is channel-based, according to an input format which may be predetermined or indicated by a format identifier, as described above with reference to task T52.

Each of encoders 100*a*-100L may be configured to calculate a set of SHC for a corresponding input audio signal (e.g., PCM stream), based on spatial information (e.g., location data) for the signal as provided by metadata (for object-based input) or a channel location data producer (for channel-based input), as described above with reference to tasks T100*a*-T100L and T120*a*-T120L. Combiner 202 is configured to calculate a sum of the sets of SHC to produce a combined set, as described above with reference to task T202. Apparatus A200 may also include an instance of encoder 300 configured to encode the combined set of SHC, as received from combiner 202 (for object-based and channel-based inputs) and/or from a scene-based input, into a common format for transmission and/or storage, as described above with reference to task T300.

Figure 17A:
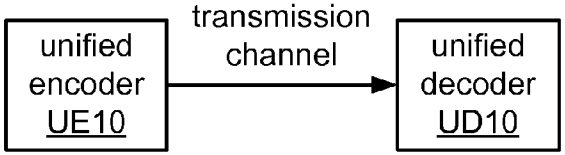
FIG. 17A shows a block diagram for a unified coding architecture.
Figure 17B:
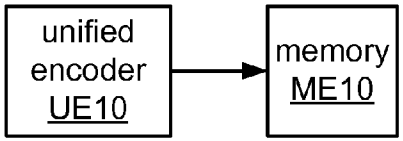
FIG. 17B shows a block diagram for a related architecture.

FIG. 17A shows a block diagram for a unified coding architecture. In this example, a unified encoder UE10 is configured to produce a unified encoded signal and to transmit the unified encoded signal via a transmission channel to a unified decoder UD10. Unified encoder UE10 may be implemented as described herein to produce the unified encoded signal from channel-based, object-based, and/or scene-based (e.g., SHC-based) inputs. FIG. 17B shows a block diagram for a related architecture in which unified encoder UE10 is configured to store the unified encoded signal to a memory ME10.

Figure 17C:
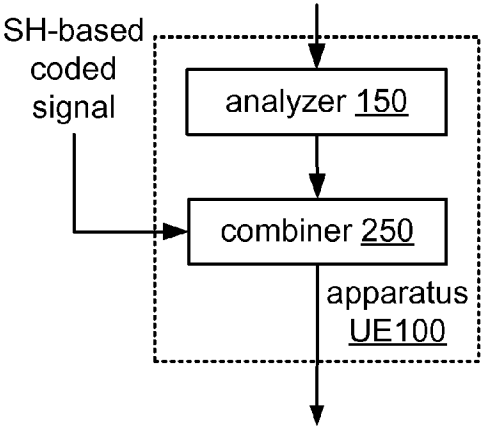
FIG. 17C shows a block diagram of an implementation UE100 of unified encoder UE10.

FIG. 17C shows a block diagram of an implementation UE100 of unified encoder UE10 and apparatus A100 that includes an implementation 150 of encoder 100 as a spherical harmonic (SH) analyzer and an implementation 250 of combiner 200. Analyzer 150 is configured to produce an SH-based coded signal based on audio and location information encoded in the input audio coded signal (e.g., as described herein with reference to task T100). The input audio coded signal may be, for example, a channel-based or object-based input. Combiner 250 is configured to produce a sum of the SH-based coded signal produced by analyzer 150 and another SH-based coded signal (e.g., a scene-based input).

Figure 17D:
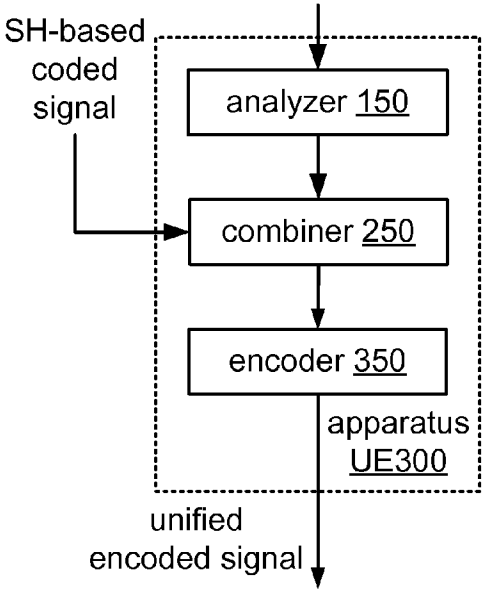
FIG. 17D shows a block diagram of an implementation UE300 of unified encoder UE100.

FIG. 17D shows a block diagram of an implementation UE300 of unified encoder UE100 and apparatus A300 that may be used for processing object-based, channel-based, and scene-based inputs into a common format for transmission and/or storage. Encoder UE300 includes an implementation 350 of encoder 300 (e.g., a unified coefficient set encoder). Unified coefficient set encoder 350 is configured to encode the summed signal (e.g., as described herein with reference to coefficient set encoder 300) to produce a unified encoded signal.

Figure 17E:
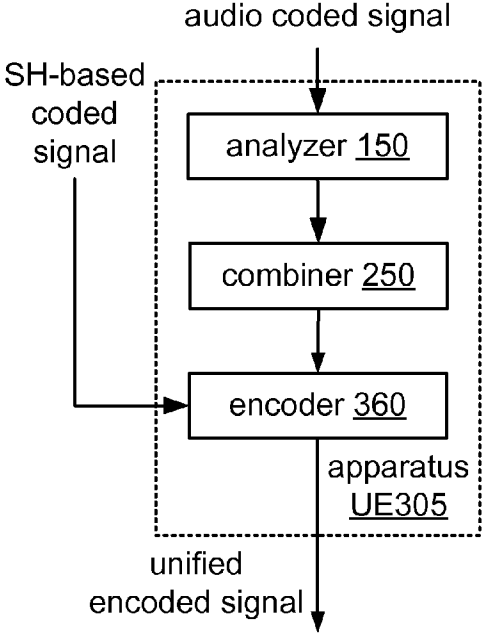
FIG. 17E shows a block diagram of an implementation UE305 of unified encoder UE100.

As a scene-based input may already be encoded in SHC form, it may be sufficient for the unified encoder to process the input (e.g., by quantization, error correction coding, redundancy coding, etc., and/or packetization) into a common format for transfer and/or storage. FIG. 17E shows a block diagram of such an implementation UE305 of unified encoder UE100 in which an implementation 360 of encoder 300 is arranged to encode the other SH-based coded signal (e.g., in case no such signal is available from combiner 250).

Figure 18:
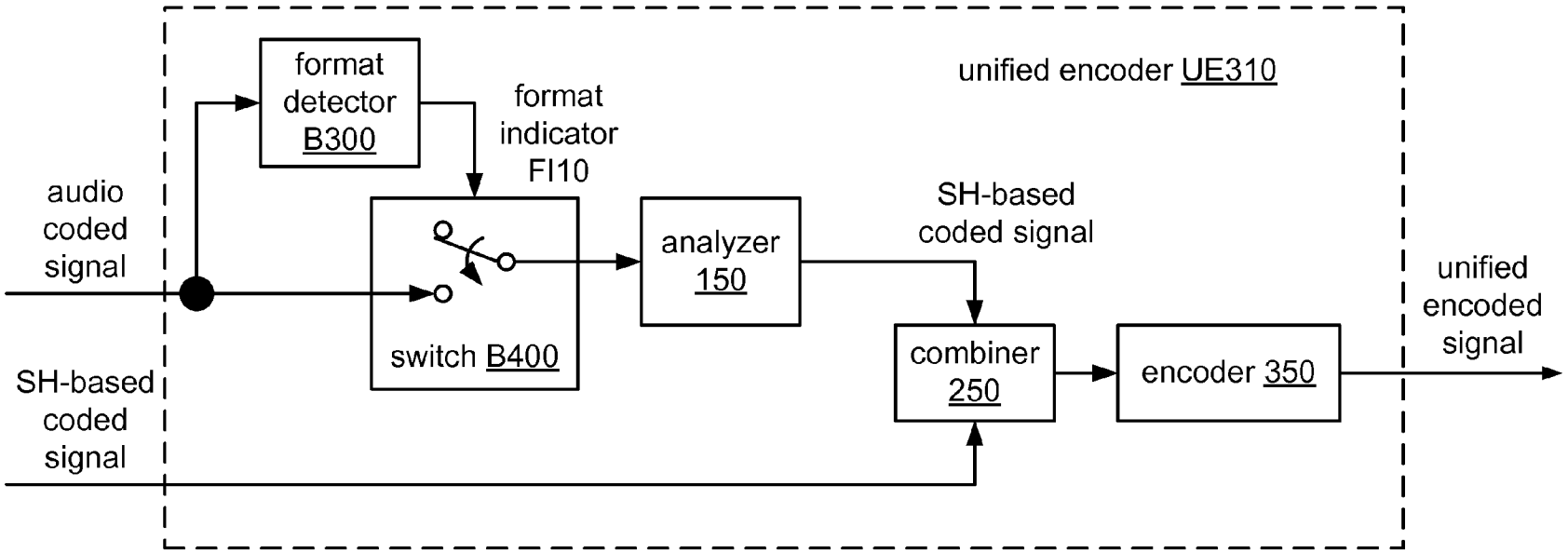
FIG. 18 shows a block diagram of an implementation UE310 of unified encoder UE300.

FIG. 18 shows a block diagram of an implementation UE310 of unified encoder UE10 that includes a format detector B300 configured to produce a format indicator FI10 based on information in the audio coded signal, and a switch B400 that is configured to enable or disable input of the audio coded signal to analyzer 150, according to the state of the format indicator. Format detector B300 may be implemented, for example, such that format indicator FI10 has a first state when the audio coded signal is a channel-based input and a second state when the audio coded signal is an object-based input. Additionally or alternatively, format detector B300 may be implemented to indicate a particular format of a channel-based input (e.g., to indicate that the input is in a 5.1, 7.1, or 22.2 format).

Figure 19A:
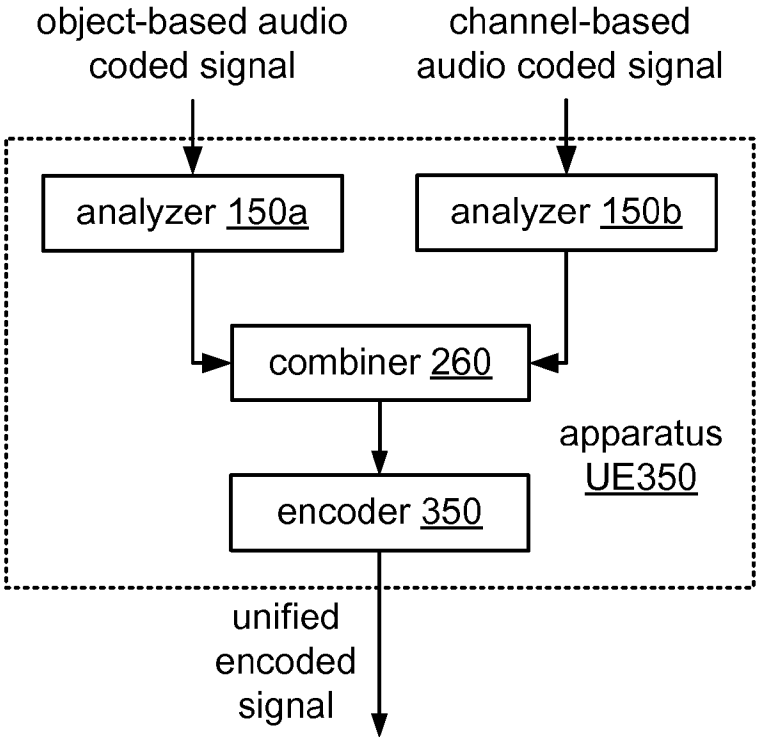
FIG. 19A shows a block diagram of an implementation UE250 of unified encoder UE100.

FIG. 19A shows a block diagram of an implementation UE250 of unified encoder UE100 that includes a first implementation 150*a* of analyzer 150 which is configured to encode a channel-based audio coded signal into a first SH-based coded signal. Unified encoder UE250 also includes a second implementation 150*b* of analyzer 150 which is configured to encode an object-based audio coded signal into a second SH-based coded signal. In this example, an implementation 260 of combiner 250 is arranged to produce a sum of the first and second SH-based coded signals.

Figure 19B:
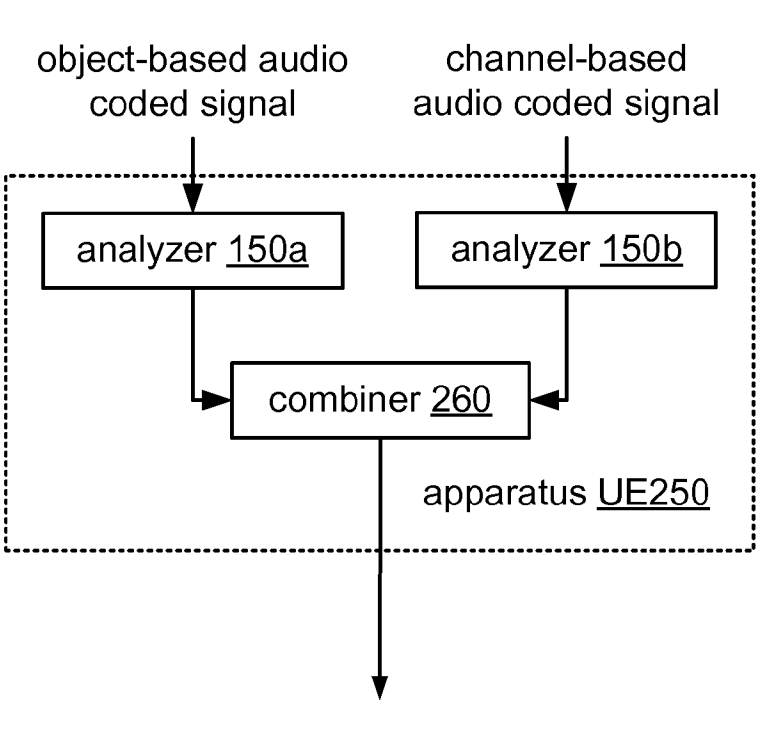
FIG. 19B shows a block diagram of an implementation UE350 of unified encoder UE250.

FIG. 19B shows a block diagram of an implementation UE350 of unified encoder UE250 and UE300 in which encoder 350 is arranged to produce the unified encoded signal by encoding the sum of the first and second SH-based coded signals produced by combiner 260.

Figure 20:
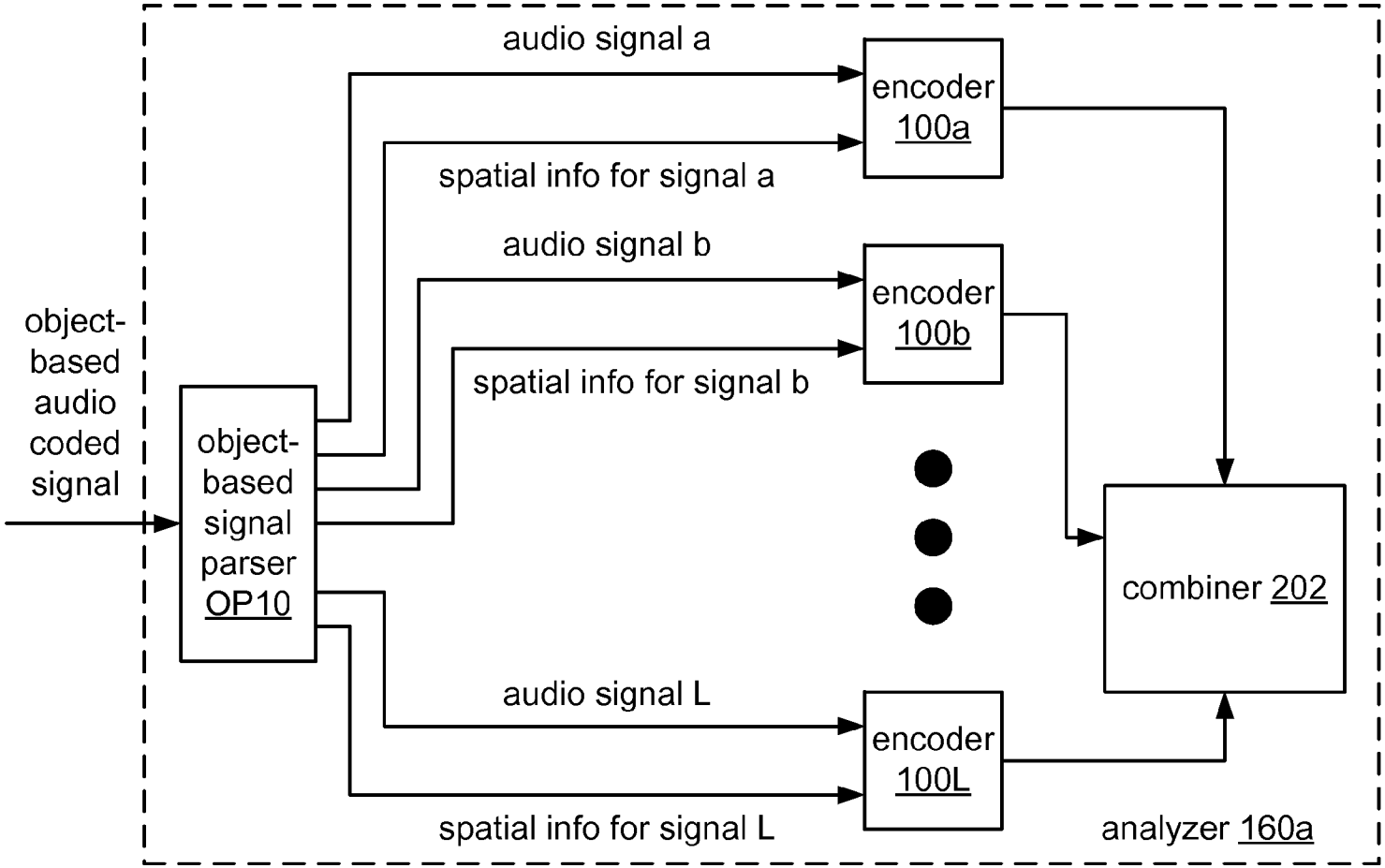
FIG. 20 shows a block diagram of an implementation 160*a* of analyzer 150*a*.

FIG. 20 shows a block diagram of an implementation 160*a* of analyzer 150*a* that includes an object-based signal parser OP10. Parser OP10 may be configured to parse the object-based input into its various component objects as PCM streams and to decode the associated metadata into location data for each object. The other elements of analyzer 160*a* may be implemented as described herein with reference to apparatus A200.

Figure 21:
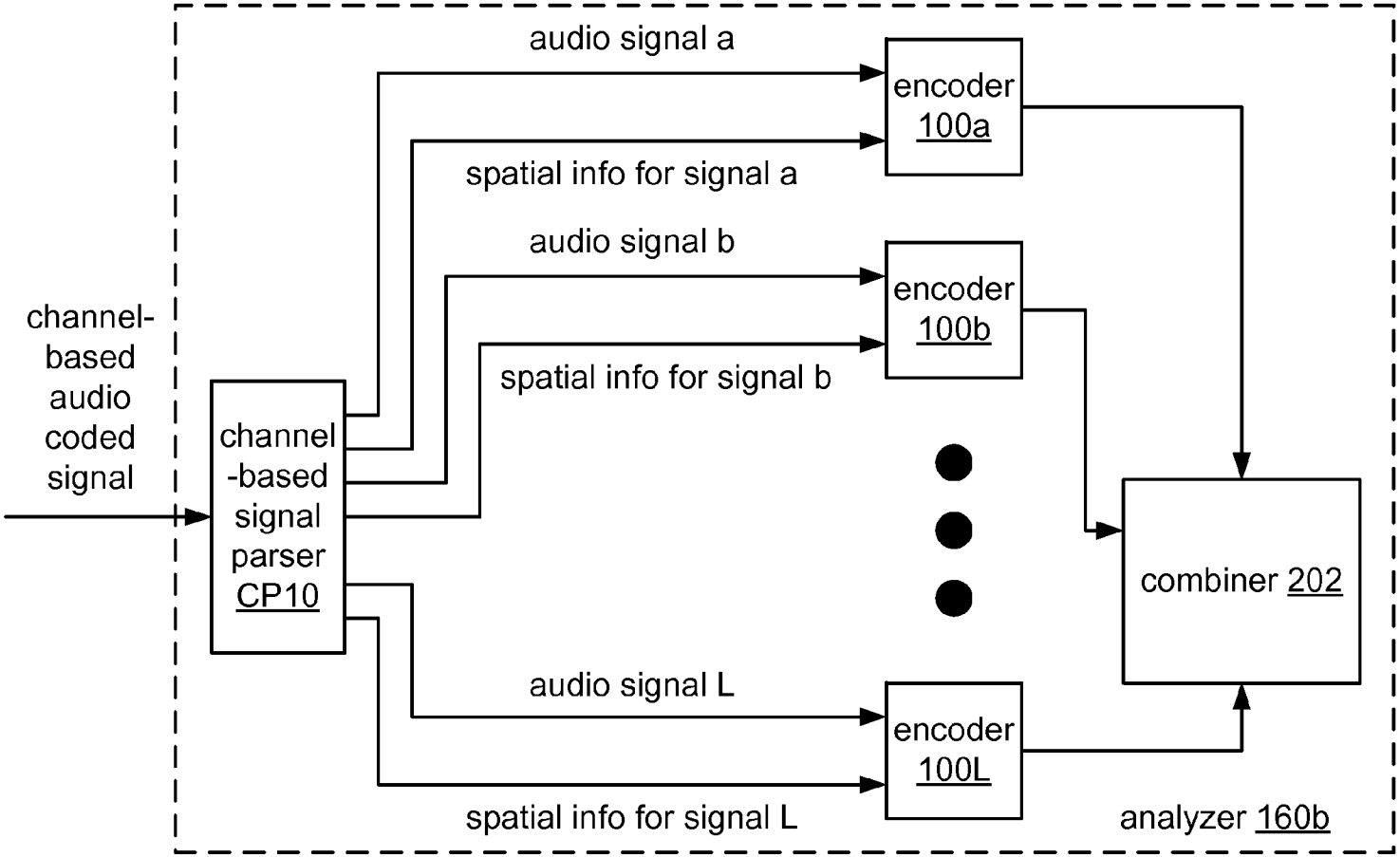
FIG. 21 shows a block diagram of an implementation 160*b* of analyzer 150*b*.

FIG. 21 shows a block diagram of an implementation 160*b* of analyzer 150*b* that includes a channel-based signal parser CP10. Parser CP10 may be implemented to include an instance of angle indicator 50 as described herein. Parser CP10 may also be configured to parse the channel-based input into its various component channels as PCM streams. The other elements of analyzer 160*b* may be implemented as described herein with reference to apparatus A200.

Figure 22B:
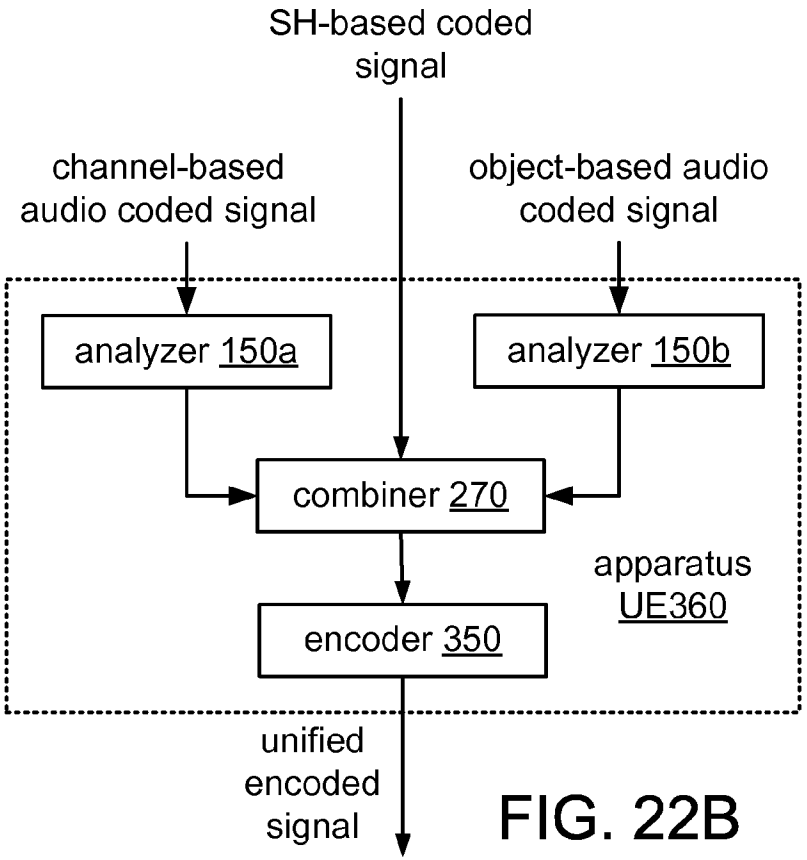
FIG. 22B shows a block diagram of an implementation UE360 of unified encoder UE350.
Figure 22A:
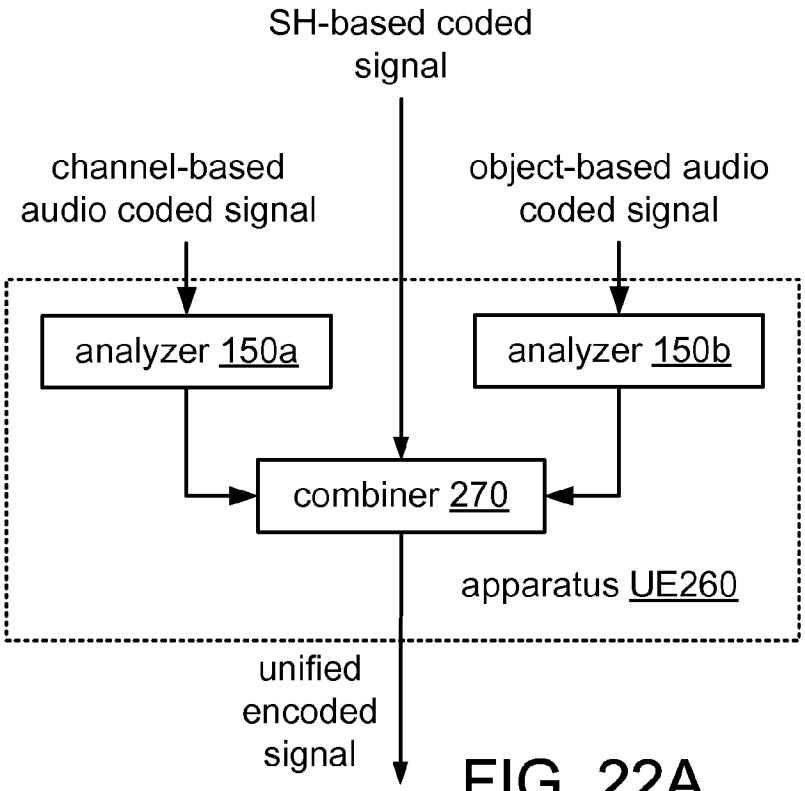
FIG. 22A shows a block diagram of an implementation UE260 of unified encoder UE250.

FIG. 22A shows a block diagram of an implementation UE260 of unified encoder UE250 that includes an implementation 270 of combiner 260, which is configured to produce a sum of the first and second SH-based coded signals and an input SH-based coded signal (e.g., a scene-based input). FIG. 22B shows a block diagram of a similar implementation UE360 of unified encoder UE350.

It may be desirable to implement MPEG encoder MP10 as shown in FIG. 3B as an implementation of unified encoder UE10 as described herein (e.g., UE100, UE250, UE260, UE300, UE310, UE350, UE360) to produce, for example, a bitstream for streaming, broadcast, multicast, and/or media mastering (for example, mastering of CD, DVD, and/or Blu-Ray® Disc)). In another example, one or more audio signals may be coded for transmission and/or storage simultaneously with SHC (e.g., obtained in a manner as described above).

The methods and apparatus disclosed herein may be applied generally in any transceiving and/or audio sensing application, including mobile or otherwise portable instances of such applications and/or sensing of signal components from far-field sources. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein (e.g., smartphones, tablet computers) may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

An apparatus as disclosure herein (e.g., any of apparatus A100, A110, A120, A200, A300, A400, MF100, MF110, MF120, MF200, MF300, MF400, UE10, UD10, UE100, UE250, UE260, UE300, UE310, UE350, and UE360) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of the elements of the apparatus may be implemented within the same array or arrays. Such an array or arrays may be implemented within one or more chips (for example, within a chipset including two or more chips).

One or more elements of the various implementations of the apparatus disclosed herein (e.g., any of apparatus A100, A110, A120, A200, A300, A400, MF100, MF110, MF120, MF200, MF300, MF400, UE10, UD10, UE100, UE250, UE260, UE300, UE310, UE350, and UE360) may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to an audio coding procedure as described herein, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., any of methods M100, M110, M120, M200, M300, and M400) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein (e.g., apparatus A100 or MF100) may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. An apparatus for object-based audio signal processing, said apparatus comprising:

an encoder configured to encode an object-based audio signal and spatial information for the object-based audio signal into a first set of basis function coefficients that describes a first sound field; and a combiner configured to combine the first set of basis function coefficients with a second set of basis function coefficients that describes a second sound field during a time interval to produce a combined set of basis function coefficients that describes a combined sound field during the time interval.

2. The apparatus according to claim 1, wherein said audio signal is one of: a frame of a corresponding stream of audio samples or a frame of a pulse-code-modulation (PCM) stream.

3. The apparatus according to claim 1, wherein said spatial information for the object-based audio signal indicates a direction in space.

4. The apparatus according to claim 1, wherein said apparatus includes a parser configured to parse an audio object that includes said object-based audio signal and said spatial information for said object-based audio signal.

5. The apparatus according to claim 1, wherein said first set of basis function coefficients describes the first sound field in at least two spatial dimensions, and wherein said second set of basis function coefficients describes the second sound field in at least two spatial dimensions.

6. The apparatus according to claim 1, wherein at least one of said first and second sets of basis function coefficients describes the corresponding sound field in three spatial dimensions.

7. The apparatus according to claim 1, wherein a total number of basis function coefficients in said first set of basis function coefficients is less than a total number of basis function coefficients in said second set of basis function coefficients.

8. The apparatus according to claim 1, wherein each basis function coefficient of said first set of basis function coefficients corresponds to a set of orthogonal basis functions or a set of spherical harmonic basis functions.

9. A method of object-based audio signal processing, said method comprising:

encoding an object-based audio signal and spatial information for the object-based audio signal into a first set of basis function coefficients that describes a first sound field; and combining the first set of basis function coefficients with a second set of basis function coefficients that describes a second sound field during a time interval to produce a combined set of basis function coefficients that describes a combined sound field during the time interval.

10. The method of claim 9, wherein said first set of basis function coefficients describes the first sound field in at least two spatial dimensions, and wherein said second set of basis function coefficients describes the second sound field in at least two spatial dimensions.

11. An apparatus for channel-based audio signal processing, said apparatus comprising:

an encoder configured to encode a channel-based audio signal and spatial information for the channel-based audio signal into a first set of basis function coefficients that describes a first sound field; and a combiner configured to combine the first set of basis function coefficients with a second set of basis function coefficients that describes a second sound field during a time interval to produce a combined set of basis function coefficients that describes a combined sound field during the time interval.

12. The apparatus according to claim 11, wherein said audio signal is one of: a frame of a corresponding stream of audio samples or a frame of a pulse-code-modulation (PCM) stream.

13. The apparatus according to claim 11, wherein the channel-based audio signal comprises a loudspeaker channel.

14. The apparatus according to claim 11, wherein said first set of basis function coefficients describes the first sound field in at least two spatial dimensions, and wherein said second set of basis function coefficients describes the second sound field in at least two spatial dimensions.

15. The apparatus according to claim 11, wherein at least one of said first and second sets of basis function coefficients describes the corresponding sound field in three spatial dimensions.

16. The apparatus according to claim 11, wherein a total number of basis function coefficients in said first set of basis function coefficients is less than a total number of basis function coefficients in said second set of basis function coefficients.

17. The apparatus according to claim 11, wherein each basis function coefficient of said first set of basis function coefficients corresponds to a set of orthogonal basis functions or a set of spherical harmonic basis functions.

18. A method of channel-based audio signal processing, said method comprising:

encoding a channel-based audio signal and spatial information for the channel-based audio signal into a first set of basis function coefficients that describes a first sound field; and combining the first set of basis function coefficients with a second set of basis function coefficients that describes a second sound field during a time interval to produce a combined set of basis function coefficients that describes a combined sound field during the time interval.

19. The method of claim 18, wherein said first set of basis function coefficients describes the first sound field in at least two spatial dimensions, and wherein said second set of basis function coefficients describes the second sound field in at least two spatial dimensions.

* * * * *